US005677705A

United States Patent [19]

Shimura et al.

[11] Patent Number: 5,677,705

[45] Date of Patent: Oct. 14, 1997

[54] DRIVE METHOD FOR DRIVING A MATRIX-ADDRESSING DISPLAY, A DRIVE CIRCUIT THEREFOR, AND A MATRIX-ADDRESSING DISPLAY DEVICE

[75] Inventors: Masato Shimura, Hitachi; Katsumi Kondo, Katsuta; Masaaki Kitajima, Hitachioota; Hiroshi Kurihara; Tatsuhisa Fujii, both of Mobara; Shigeyuki Nishitani, Ebina, all of Japan

[73] Assignee: Hitachi, Ltd., Tokyo, Japan

[21] Appl. No.: 262,906

[22] Filed: Jun. 21, 1994

[30] Foreign Application Priority Data

Jul. 12, 1993 [JP] Japan ..... 5-171320

[51] Int. Cl.[6] ..... G09G 3/36

[52] U.S. Cl. ..... 345/95; 345/100; 345/210

[58] Field of Search ..... 345/94, 95, 96, 345/98, 99, 100, 103

[56] References Cited

U.S. PATENT DOCUMENTS 3,668,639 6/1972 Harmuth ..... 345/98

FOREIGN PATENT DOCUMENTS 0507061 10/1992 European Pat. Off. ..... 345/98
56-123595 9/1981 Japan .
56-138789 10/1981 Japan .

OTHER PUBLICATIONS

"New Adressing Techniques For Multiplexed Liquid Crystal Displays" by T.N. Ruckmongathan, SID, vol. 24/3 1983.

1988 International Display Research Conference by T.N. Ruekmongathan, 1988 IEEE.

"Ultimate Limits for Matrix Addressing of RMS–Responding LCD" IEEE Transactions on Electron Devices, vol. ED–26, No. 5, May 1989, pp. 795–802.

"Active Addressing Method for High–contrast Video–Rate STN Displays" SID '92 Digest.

"Hardware Architectures for Video–Rate, Active Addressed STN Displays", Japan Display '92, pp. 503–506.

*Primary Examiner*—Steven Saras

*Attorney, Agent, or Firm*—Antonelli, Terry, Stout & Kraus, LLP

[57] ABSTRACT

The object of the invention is to provide a drive method suitable for driving a fast-responding STN liquid crystal display device which ensures a minimized cross talk and improved contrast in display. The drive method comprises a memory means for storing display data corresponding to a plurality of lines, a function generating means for generating a drive function for the row electrodes, an arithmetic means for computing the outputs from the foregoing means, a column electrode drive means for driving the column electrodes in dependency on the output from the arithmetic means, and a row electrode drive means for driving the row electrodes in accordance with respective row electrode drive functions. As a voltage function to be applied to each row during drive operation, a sum of a plurality of orthogonal functions is utilized. Thereby, degradation in contrast due to display patterns as well as the cross talk can be minimized. Further, arithmetic operation can be simplified in gradation display since application of a compensating voltage waveform is no more required.

10 Claims, 15 Drawing Sheets

DRIVE METHOD FOR DRIVING A MATRIX-ADDRESSING DISPLAY, A DRIVE CIRCUIT THEREFOR, AND A MATRIX-ADDRESSING DISPLAY DEVICE

BACKGROUND OF THE INVENTION

1. Field of the Invention

The present invention relates to a matrix addressing display device, and more particularly it relates to a drive method for driving the matrix addressing display device at a high speed and high contrast, and a drive circuit therefor.

As display picture elements or pixels for use in the matrix addressing display device there are used liquid crystals, translucent ceramics, and so on which make use of the electro-optic effect, or laser arrays, LEDs, ELs, plasma displays, etc. which make use of luminescence or fluorescence.

2. Related Art

As related drive methods for driving a matrix addressing liquid crystal display, there have been proposed such prior arts as "Ultimate Limits for Matrix Addressing of RMS-Responding Liquid-Crystal Display" appeared in IEEE Transactions on Electron Devices, Vol. ED-26, No. 5, May 1979, pp. 795–802, and another as appeared in SID'92 Digest: Active Addressing Method for High-Contrast Video-rate STN Displays. The proposed display methods according to these prior arts apply to its row electrode a voltage in dependency on orthogonal functions, and apply to its column electrode a function of a sum-of-products obtained by multiplying every display information on its column corresponding respective functions on the scanning side. With reference to FIGS. 2 through 5, their drive methods will be discussed in detail in the following.

FIG. 2 is a diagram illustrating a structure of a liquid crystal display portion with N lines×M columns matrix construct in which respective cross points between respective row electrodes and respective column electrodes form respective display dots. Row electrodes in number N are applied with respective voltages shown by respective functions of f(1,t)–f(N,t), and column electrodes in number M are applied with respective voltages shown by respective functions of g(1,t)–g(M,t). U(i,j) represents a voltage applied to a dot at a cross point between line i and column j, the voltage being a differential voltage between f(i,t) and g(j,t). With reference to FIG. 3 there is shown a diagram indicative of an example of orthogonal functions normally applied to row electrodes which are presently used as a drive waveform for driving STN liquid crystals. With reference to FIGS. 2 and 3, some of the drive methods currently employed for driving the STN liquid crystals will be discussed below. Assuming that f(i,t) is designated by a function as shown in FIG. 3, f(i,t) and g(j,t) can be expressed by the following equations 1 and 2, respectively.

$$f(i,t) = F_P \cdot \delta(i,t) \qquad \text{eq. (1)}$$

$$g(j,t) = \frac{1}{\sqrt{N}} \sum_{i=1}^{N} P(i,j) f(i,t) \qquad \text{eq. (2)}$$

Where δ(i,t)=1 when i=t, and δ(i,t)=0 when i is not equal to t, and where $F_P$ is a constant given by equation (3) as follows.

$$F_P = \sqrt{\frac{\sqrt{N}}{2(\sqrt{N}-1)}} \qquad \text{eq. (3)}$$

P(i,j) designates display information on a dot at a cross point between line i and column j, which becomes −1 when display is ON, and becomes 1 when display is OFF. In this instance, a Urms (i,j) which is an rms value of a voltage applied according to U(i,j) to a display element of line i and column j can be calculated as follows using equations (1), (2) and (3).

$$\begin{aligned} Urms(i,j) &= \left[\frac{1}{T}\int_0^T (f(i,t)-g(j,t))^2 dt\right]^{1/2} \\ &= \left[\frac{1}{T}\int_0^T f^2(i,t)dt + \frac{1}{T}\int_0^T g^2(j,t)dt - \frac{2}{T}\int_0^T f(i,t)g(j,t)dt\right]^{1/2} \end{aligned}$$

where, the foregoing equation can be transformed as follows by assuming T=N, $$\frac{1}{T}\int_0^T f(i,t)^2 dt = \frac{1}{N}\sum_{t=1}^{N}(F_P\delta(i,t))^2 = \frac{\sqrt{N}}{2(\sqrt{N}-1)}$$

$$\begin{aligned} \frac{1}{T}\int_0^T g(j,t)^2 dt &= \frac{1}{N}\sum_{t=1}^{N}\left[\frac{1}{\sqrt{N}}\sum_{i=1}^{N} P(i,j)f(i,t)\right]^2 \\ &= \frac{1}{N}\sum_{t=1}^{N}\left[\frac{1}{\sqrt{N}}\sum_{i=1}^{N} P(i,j)\sqrt{\frac{N\sqrt{N}}{2(\sqrt{N}-1)}} = \delta(i,t)\right]^2 \\ &= \frac{1}{N}\cdot\frac{1}{N}\ \frac{N\sqrt{N}}{2(\sqrt{N}-1)}\sum_{t=1}^{N}\left[\sum_{i=1}^{N} P(i,j)\delta(i,t)\right]^2 \\ &= \frac{1}{N}\ \frac{\sqrt{N}}{2(\sqrt{N}-1)}\cdot N = \frac{\sqrt{N}}{2(\sqrt{N}-1)} \end{aligned}$$

$$\begin{aligned} \frac{2}{T}\int_0^T f(i,t)g(j,t)dt &= \frac{2}{N}\sum_{t=1}^{N} f(i,t)\sum_{i=1}^{N}\frac{1}{\sqrt{N}} P(i,j)f(i,t) \\ &= \frac{2}{N}\sum_{t=1}^{N}\sqrt{\frac{N\sqrt{N}}{2(\sqrt{N}-1)}}\cdot \\ &\quad \delta(i,t)\sum_{i=1}^{N}\frac{1}{\sqrt{N}} P(i,j)\sqrt{\frac{N\sqrt{N}}{2(\sqrt{N}-1)}}\cdot\delta(i,t) \\ &= \frac{2}{N\sqrt{N}}\cdot\frac{N\sqrt{N}}{2(\sqrt{N}-1)}\cdot\sum_{t=1}^{N}\delta(i,t)\sum_{i=1}^{N} P(i,j)\delta(i,t) \\ &= \frac{2}{2(\sqrt{N}-1)}\cdot P(i,j) \end{aligned}$$

$$\therefore Urms(i,j) = \left[\frac{\sqrt{N}}{2(\sqrt{N}-1)} + \frac{\sqrt{N}}{2(\sqrt{N}-1)} - \frac{2}{2(\sqrt{N}-1)} P(i,j)\right]^{1/2}$$

-continued $$= \left[ \frac{2\sqrt{N}}{2(\sqrt{N}-1)} - \frac{2P(i,j)}{2(\sqrt{N}-1)} \right]^{1/2}$$

From the foregoing computation, Urms(i,j) becomes equation (4). At this time when display is ON, it holds that P(i,j)=−1, thus, equation (4) becomes equation (5). When display is OFF, it holds that P(i,j)=1, thus, it becomes equation (6).

$$Urms(i,j) = \left[ \frac{2\sqrt{N}}{2(\sqrt{N}-1)} - \frac{2P(i,j)}{2(\sqrt{N}-1)} \right]^{1/2} \quad \text{eq. (4)}$$

$$Urms(i,j) = \left[ \frac{2\sqrt{N}}{2(\sqrt{N}-1)} - \frac{-2}{2(\sqrt{N}-1)} \right]^{1/2} = \left[ \frac{\sqrt{N}+1}{\sqrt{N}-1} \right]^{1/2} \quad \text{eq. (5)}$$

$$Urms(i,j) = \left[ \frac{2\sqrt{N}}{2(\sqrt{N}-1)} - \frac{2}{2(\sqrt{N}-1)} \right]^{1/2} = 1 \quad \text{eq. (6)}$$

Thereby, an rms value of a voltage to be applied to a particular display pixel on line i and column j according to U(i,j) is expressed by equation (5) or (6) in dependency on whether P(i,j) indicative of information of its dot is ON or OFF. Since U(i,j) is given by [f(i,t)−g(j,t)], its waveforms become as shown in FIG. 4 according to equations (2) and (3), where S1, S2 and S3 can be expressed as follows.

$$S1 = \begin{cases} \sqrt{\frac{N\sqrt{N}}{2(\sqrt{N}-1)}} + \sqrt{\frac{\sqrt{N}}{2(\sqrt{N}-1)}} & P(i,j) = \text{DISPLAY ON} \\ \sqrt{\frac{N\sqrt{N}}{2(\sqrt{N}-1)}} - \sqrt{\frac{\sqrt{N}}{2(\sqrt{N}-1)}} & P(i,j) = \text{DISPLAY OFF} \end{cases}$$

$$S2 = \sqrt{\frac{\sqrt{N}}{2(\sqrt{N}-1)}}$$

$$S3 = -\sqrt{\frac{\sqrt{N}}{2(\sqrt{N}-1)}}$$

Where, for N=240, it results in that S1=12.1 (for display ON at line i, column j) or 10.6 (for display OFF at line i, column j), S2=0.73 and S3=−0.73, which implies that a large voltage is applied once per frame (at i=t for t=1−N period) and the rest of that period is applied low voltages. Thereby, in any fast responsive STN liquid crystal, its display brightness is lowered during the period when the low voltages are applied. In order to solve such a problem, a drive method has been proposed which will be described below. FIG. 5 shows examples of orthogonal functions called as the Walsh function having 8 divisions for example. Here, assume that Walsh functions with T divisions are used as functions to be applied to row electrodes of the liquid crystal display unit shown in FIG. 2, and that Walsh functions in number N out of T (T≧N) are selectively applied to f(i,t), then an rms value of voltage Urms(i,j) on a display pixel at line i and column j can be expressed as follows.

$$Urms(i,j) = \frac{1}{T}\int_0^T [(f(i,t)-g(j,t))^2]^{1/2}$$

$$= \left[ \frac{1}{T}\int_0^T f(i,t)^2 dt + \frac{1}{T}\int_0^T g(j,t)^2 dt - \frac{2}{T}\int_0^T f(i,t)g(j,t)dt \right]^{1/2}$$

where, $$\frac{1}{T}\int_0^T f(i,t)^2 dt = \frac{1}{T}\sum_{t=1}^{T} (FPW(i,t))^2$$

$$= \frac{1}{T}[FP^2W(i,1)^2 + FP^2W(i,2)^2 + \ldots + FP^2W(i,T)^2]$$

$$= \frac{1}{T}\cdot FP^2\cdot T(\pm 1)^2 = FP^2 = \frac{\sqrt{N}}{2(\sqrt{N}-1)}$$

$$\frac{1}{T}\int_0^T g(j,t)^2 dt = \frac{1}{T}\sum_{t=1}^{T}\left[\frac{1}{\sqrt{N}}\sum_{i=1}^{N} P(i,j)\cdot\sqrt{\frac{\sqrt{N}}{2(\sqrt{N}-1)}}\,W(i,t)\right]^2$$

$$= \frac{1}{T}\cdot\frac{1}{N}\cdot\frac{\sqrt{N}}{2(\sqrt{N}-1)}\sum_{t=1}^{T}\sum_{i=1}^{N}(P(i,j)\cdot W(i,t))^2$$

$$= \frac{1}{T}\cdot\frac{1}{N}\cdot\frac{\sqrt{N}}{2(\sqrt{N}-1)}\sum_{t=1}^{T}[P(i,j)^2 W(l,t)^2 + \ldots + P(N,j)^2 W(N,t)^2]$$

$$= \frac{1}{T}\cdot\frac{1}{N}\cdot\frac{\sqrt{N}}{2(\sqrt{N}-1)}\cdot T\cdot N = \frac{\sqrt{N}}{2(\sqrt{N}-1)}$$

$$\frac{2}{T}\int_0^T f(i,t)g(j,t)dt = \frac{2}{T}\sum_{t=1}^{T} FPW(i,t)\sum_{i=1}^{N}\frac{1}{\sqrt{N}}P(i,j)FPW(i,t)$$

$$= \frac{2}{T}\cdot\frac{1}{\sqrt{N}}\cdot\frac{\sqrt{N}}{2(\sqrt{N}-1)}\sum_{t=1}^{T} W(i,t)\sum_{i=1}^{N} P(i,j)W(i,t)$$

$$= \frac{2}{T}\cdot\frac{1}{2(\sqrt{N}-1)}\sum_{t=1}^{T} P(i,j)W(i,t)^2$$

$$= \frac{2P(i,j)}{2(\sqrt{N}-1)}$$

$$\therefore Urms(i,j) = \left[ \frac{\sqrt{N}}{2(\sqrt{N}-1)} + \frac{\sqrt{N}}{2(\sqrt{N}-1)} - \frac{2P(i,j)}{2(\sqrt{N}-1)} \right]^{1/2}$$

$$= \left[ \frac{2\sqrt{N}}{2(\sqrt{N}-1)} - \frac{2P(i,j)}{2(\sqrt{N}-1)} \right]^{1/2}$$

Where, f(i,t) and g(j,t) are assumed to be given by the following equations (7) and (8), respectively.

$$f(i,t) = FPW(i,t) \quad \text{eq. (7)}$$

$$g(j,t) = \frac{1}{\sqrt{N}} \sum_{i=1}^{N} P(i,j)f(i,t) \quad \text{eq. (8)}$$

Where W(i,t) represents a Walsh function which takes a value of 1 or −1, and FP is a constant expressed by equation (9).

$$FP = \sqrt{\frac{\sqrt{N}}{2(\sqrt{N}-1)}} \quad \text{eq. (9)}$$

Thereby, as has been explained hereinabove, the rms value of a voltage to be applied to a display element on line i and column j according to U(i,j) is given by the following equation.

$$Urms(i,j) = \left[ \frac{2\sqrt{N}}{2(\sqrt{N}-1)} - \frac{2P(i,j)}{2(\sqrt{N}-1)} \right]^{1/2}$$

This equation is the same as equation (4), which assumes a value to be determined by equation (5) when display is ON, and a value to be determined by equation (6) when display is OFF. Namely, even if Walsh functions as shown in FIG. 5 are given to a row electrode as a voltage function, the rms value of voltage to be applied to a particular display element on line i and column j will be expressed, depending on the ON or OFF state of its display, by equations (5) or (6).

Further, let's consider g(j,t) of equation (8) to be transformed as follows.

$$\begin{aligned} g(j,t) &= \frac{1}{\sqrt{N}} \sum_{i=1}^{N} P(i,j)f(i,t) \\ &= \frac{FP}{\sqrt{N}} (2D-N) \end{aligned} \quad \text{eq. (10)}$$

Where, D is a coincidence number indicative of coincidences between P(i,j) which is display information of pixels on a column j electrode and W(i,j) (where i=1–N, and P(i,j) and W(i,j) take ±1, respectively).

In this instance, the value of D is shown by a normal distribution which will be expressed as follows.

$$P(D) \simeq \sqrt{\frac{2}{\pi N}} \exp\left[ \frac{-(2D-N)^2}{2} N \right] \quad \text{eq. (11)}$$

According to equation (11), since D takes a value which follows a normal distribution centered around N/2, a value of equation (10) also follows a normal distribution. Thereby, an averaged voltage more uniformly distributed in comparison with that in FIG. 4 can be applied during a period t=1 through N for U(i,J) which is (f(i,t)–g(j,t)).

With respect to the prior art drive methods for driving display devices there have been described in Japanese Patent Application Laid-open Nos. 56-138789 and 56-123595, but there have been no descriptions nor suggestions regarding an application of voltage waveforms of a weighted sum of orthogonal functions.

SUMMARY OF THE INVENTION

According to the prior art drive methods described above, when the voltage functions to be applied to row electrodes are assumed to be Walsh functions, a voltage function g(i,t) to be applied to column electrodes becomes equation (12) through equations (7) and (8). Thereby, in order to determined a voltage to be applied to a particular dot at a time t, a sum of products of display information P(i,j) for i=1–N and a Walsh function W(i,t) is calculated. In this instance, when there exists a large correlation between a display information pattern on the j-th column (P(1,j), P(2,j) . . . , P(N,j); hereinafter referred to as a display vector) and a Walsh function value pattern to be applied at time t (W(i,t), W(2,t) . . . , W(N,t); hereinafter referred to as a scan vector), there occurs a large bias in a voltage waveform to be applied to a pixel. This will be explained by way of example of a matrix display using 8 lines by 8 columns matrix in the following. 8 function waveforms of f(1, tl) through f(8, tl) (where, l=1, . . . , 16) as shown in FIG. 6 are used as functions for constituting a scan signal. When l=5, its corresponding scan vector becomes (1, 1, 1, −1, −1, 1, −1, 1). When this matrix is adapted to display a display matrix (1, 1, 1, −1, −1, 1, −1, 1) having a large correlation with the scan vector, there resulted in a biased waveform with such instances of applied voltages 8 and 0 unevenly distributed as shown in the bottom portion of FIG. 6. In general, not limited to the 8 rows by 8 column matrix display, in the case when one function is adapted to correspond to each row to display an N rows by M columns matrix display, since any display having a large correlation with scan vectors will results in an increase in the absolute value of the applied voltage, its driver load becomes greater. Further, there arises such a problem that since the bias in the waveforms of applied voltages becomes greater, the brightness and contrast degrade in the fast responding liquid crystal cells due to that the liquid crystal cells are likely to respond during the period at 0 voltage as described above. On the other hand, when the voltage functions to be applied to the row electrodes are assumed to be such functions as shown in FIG. 3, a voltage function g(j,t) to be applied to a column electrode can be expressed by equation (13) as follows, which does not need any sum of products, thereby being independent of the display vectors. In this case, however, since only once in N times U(i,j) becomes a high voltage as shown in FIG. 4, a load on a driver become excessive, and since the remaining (N−1) times it becomes low voltages, it is considered in the case of the high responding STN liquid crystal displays that its contrast is degraded.

$$\begin{aligned} g(j,t) &= \frac{1}{\sqrt{N}} \sum_{i=1}^{N} P(i,j)FPW(i,t) \\ &= \frac{FP}{\sqrt{N}} \sum_{i=1}^{N} P(i,j)W(i,t) \end{aligned} \quad \text{eq. (12)}$$

$$\begin{aligned} g(j,t) &= \frac{1}{\sqrt{N}} \sum_{i=1}^{N} P(i,j)FP\delta(i,t) \\ &= \frac{FP}{\sqrt{N}} \sum_{i=1}^{N} P(i,j)\delta(i,t) \\ &= \frac{FP}{\sqrt{N}} P(t,j) \end{aligned} \quad \text{eq. (13)}$$

A matrix addressing liquid crystal display panel with 8 rows by 8 columns which comprises: two sheets of glass substrates with a high flatness which have patterned ITO electrodes, an $SiO_2/TiO_2$ film and an oriented polyimide film all mounted on the substrate; a cholesteric liquid crystal compound including two ring PCH compounds with a poise of 18 cp and a birefringence of 0.168 which is inserted being twisted by 240 degrees into a cell having a gap of 5 μm formed between the two sheets of substrates; two sheets of polycarbonate film phase difference plates disposed on either one side and a polarizing plate disposed on both sides under such a condition that a relatively dark state of display is maintained when no voltage is applied, is utilized to measure a relationship between rms values of applied voltages and resultant contrasts of pixels when it was driven by the aforementioned drive method, the result of which is shown in FIG. 7. A curve 1 plots contrasts obtained when the same was driven by static drive waveforms the maximum contrast of which became 25. From this result, it was arranged for the following respective drive methods for driving the above matrix addressing liquid crystal panel to control respective driver voltages for driving respective row electrodes and column electrodes such that an rms value of voltage Vns in the off-state of the pixels became 2.32 V. A curve 2 plots contrasts when the same was driven by the prior art line-sequential drive method, the maximum contrast of which dropped drastically to 5. A curve 3 is an example obtained by driving by the orthogonal function drive method proposed by the Infocus Company in USA. This was obtained on the condition that there existed a very small correlation between the display vector and the scanning vector. Its maximum contrast was 20 which was a great increase compared to those obtained by the prior art line-sequential drive method. However, when the correlation between the display vector and the scanning vector increased due to the changes in display patterns, its maximum contrast dropped to 10 indicating a large change and dependency on the display patterns. When a display vector (1, −1, 1, −1, 1, −1, 1, 1) was displayed on the first column of the LCD panel and a display vector (1, 1, 1, −1, −1, 1, −1, 1) on the third column thereof, a ratio of brightness Br(4, 1) and Br(4, 3) in the off-state on the fourth row was such that Br(4, 1)/Br(4, 3)=0.6. It has been thus confirmed that a cross talk has occurred due to a direct dependency of g(j, tl) on the display vectors.

In view of and to overcome the foregoing problems associated with the prior arts, a first object of the invention is to provide a drive method which is less affected by the patterns of display information and thus is capable of applying a voltage which has a less biased waveform. A second object of the invention is to newly define a voltage function suitable to be applied to the row electrode which causes no decreases in contrast even when applied to a fast responding STN liquid crystal display, and provide a circuit configuration therefor.

In order to accomplish the foregoing objects of the invention, there have been incorporated a computing means for computing a plurality of outputs from an orthogonal function generating means to produce a row function signal, or a function generating means for generating a row function signal at least including a weighted sum of a plurality of orthogonal functions, the function generating means for generating orthogonal functions producing said row function signal, a line memory means for storing a display data for displaying elements on the column electrode of an X-th column, a computing means for computing outputs from the line memory and the function generating means, and a voltage generating means for converting the output from the computing means into a signal voltage. Then, as a scanning signal to be applied to the row electrode of a p-th row, a particular waveform which has been obtained as a weighted sum of a plurality of functions which are orthogonal each other is utilized, while the other rows are applied with waveforms composed of the plurality of orthogonal functions which are applied to the row electrode of p-th row so as to accomplish the objects of the invention. Here, the weighted sum is intended to include a weighted subtraction as well.

The orthogonal function generating means is adapted to generate at least (N+1) functions which are orthogonal to each other for the row electrodes with N rows, and the computing means computes to obtain a weighted sum of a plurality of functions which are orthogonal to each other for applying at least to one of the rows, then thus computed weighted sum row function is supplied to a row electrode drive means of the LCD. Alternatively, the row function generating means is adapted to generate N functions at least including a weighted sum of a plurality of orthogonal functions which are orthogonal to each other to supply to the row electrode drive means of the LCD. Further, the function generating means is adapted to generate the same value as that of the orthogonal functions applied to the row electrode of the p-th row as described above, the output of which is computed with a corresponding output from the line memory, the result of which computation is converted to a voltage which is then supplied to the column electrode drive means.

BRIEF DESCRIPTION OF THE DRAWINGS

The present invention will be understood more clearly by the following description of the preferred embodiments of the invention in conjunction with the accompanying drawings in which.

DESCRIPTION OF THE NUMERALS

Figure 1:
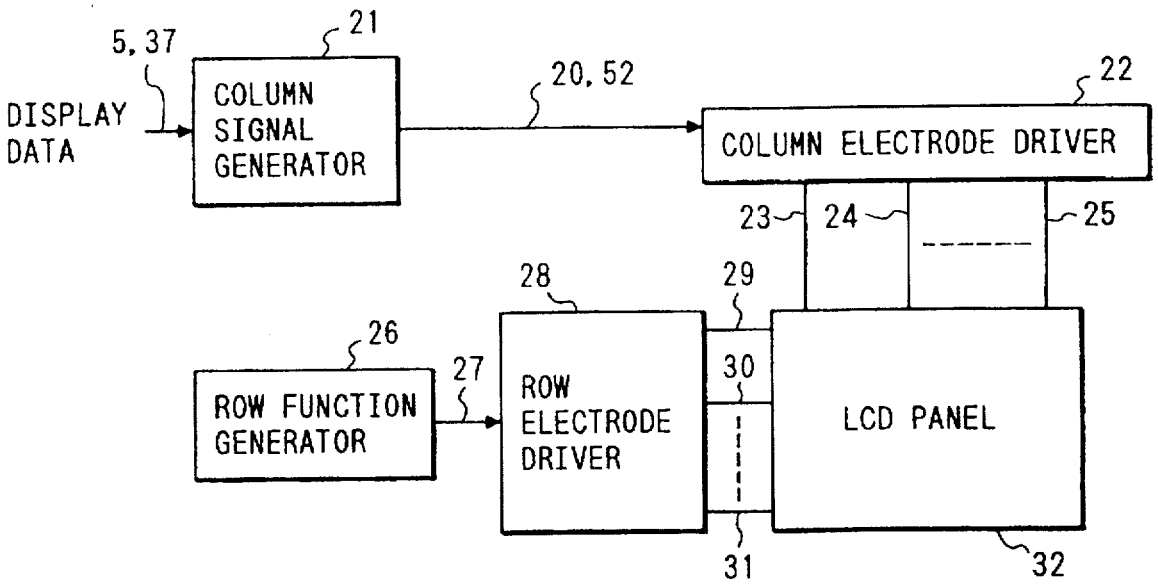
FIG. 1 is a block diagram of a liquid crystal display device of one embodiment of the invention.
Figure 2:
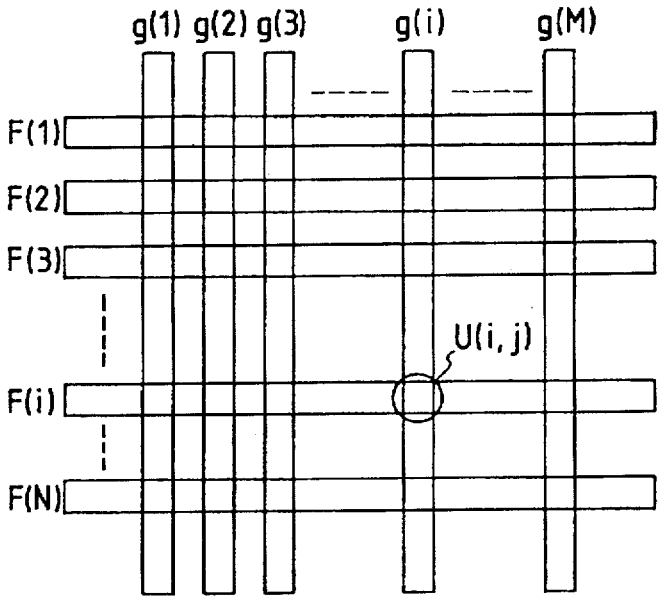
FIG. 2 PRIOR ART
FIG. 2 is a liquid crystal display portion with an N row×M column matrix structure.
Figure 3:
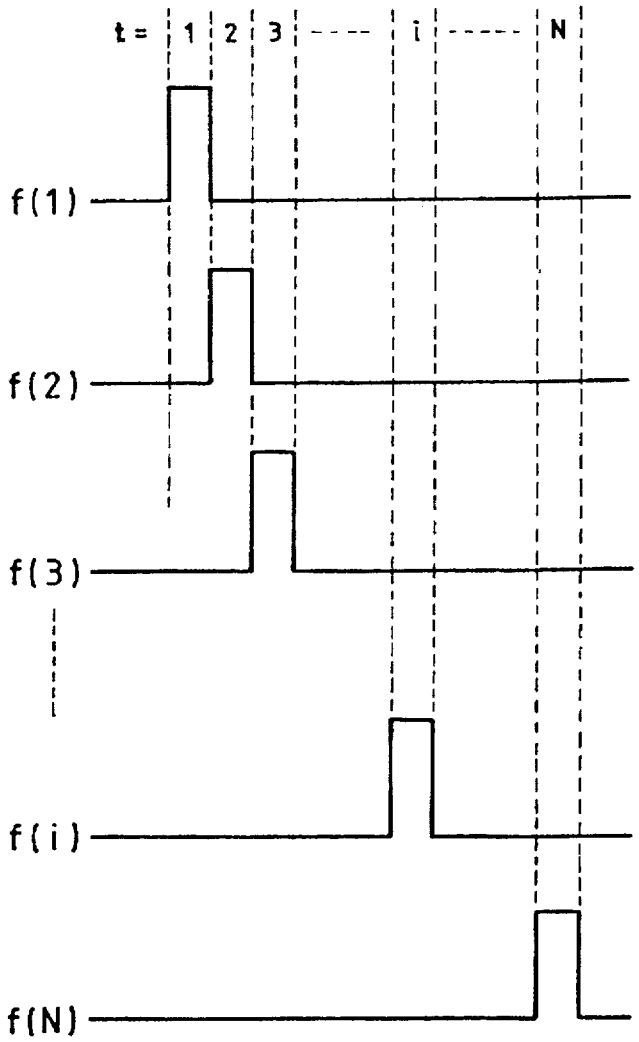
FIG. 3 PRIOR ART
FIG. 3 is a block diagram illustrative of an example of an orthogonal function normally applied to a row electrode as a drive waveform to drive an STN liquid crystal display.
Figure 4:
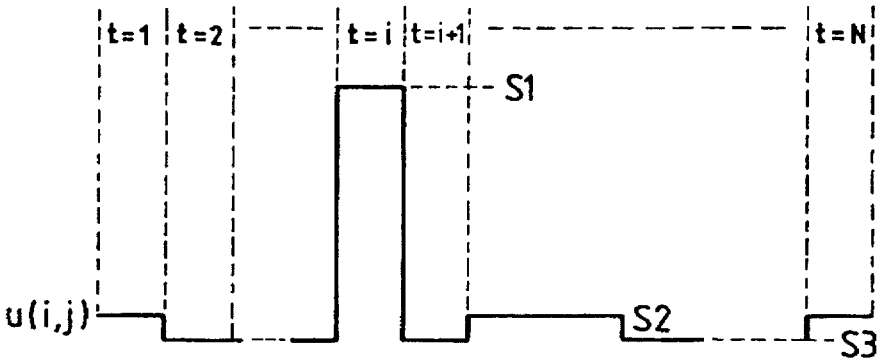
FIG. 4 PRIOR ART
FIG. 4 is a diagram illustrative of a liquid crystal drive voltage waveform U(i,j) to be applied to a display element or pixel at a cross point on row i and column j.
Figure 5:
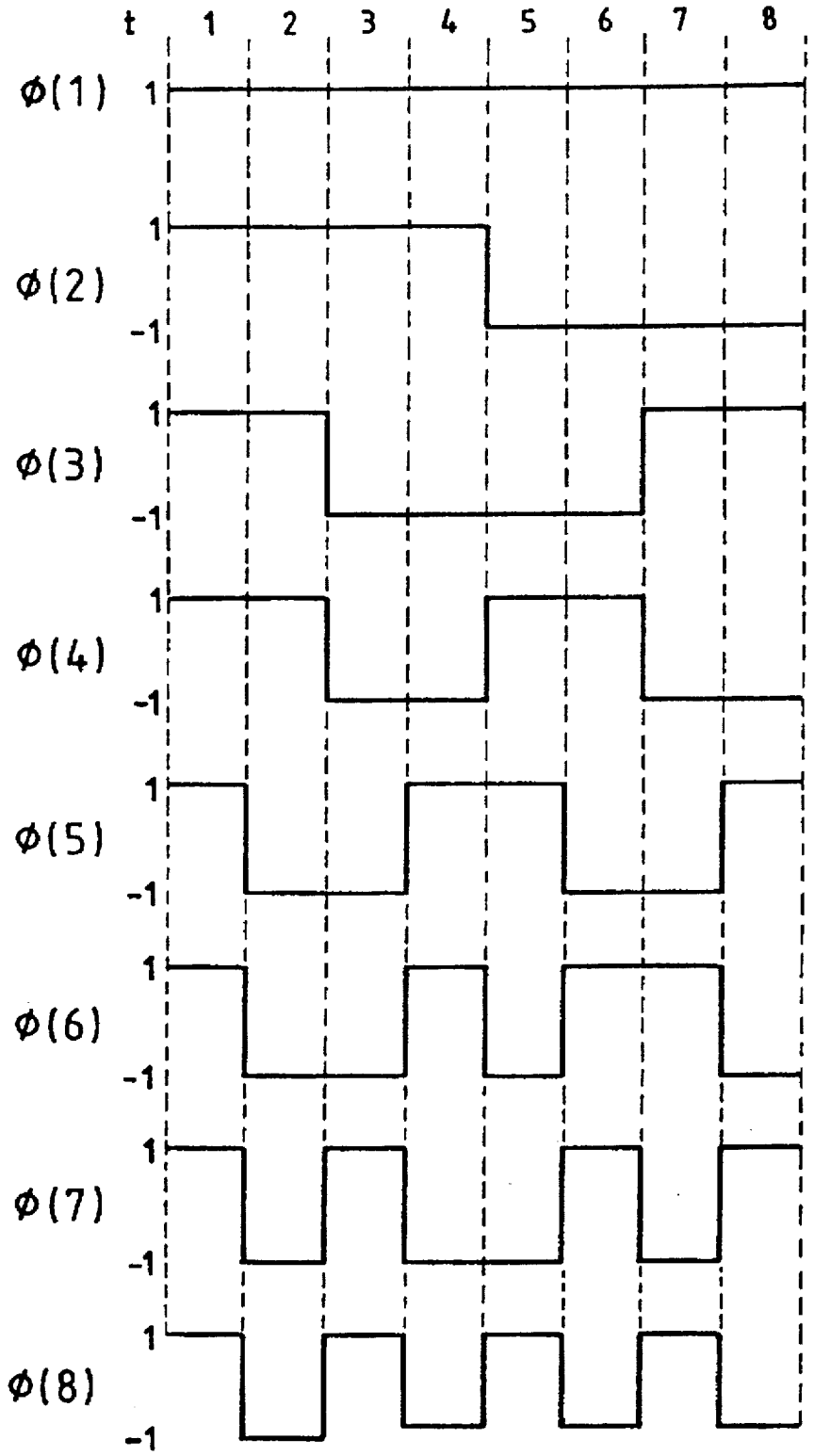
FIG. 5 PRIOR ART
FIG. 5 shows orthogonal functions 1 through 8, so-called Walsh functions.
Figure 6:
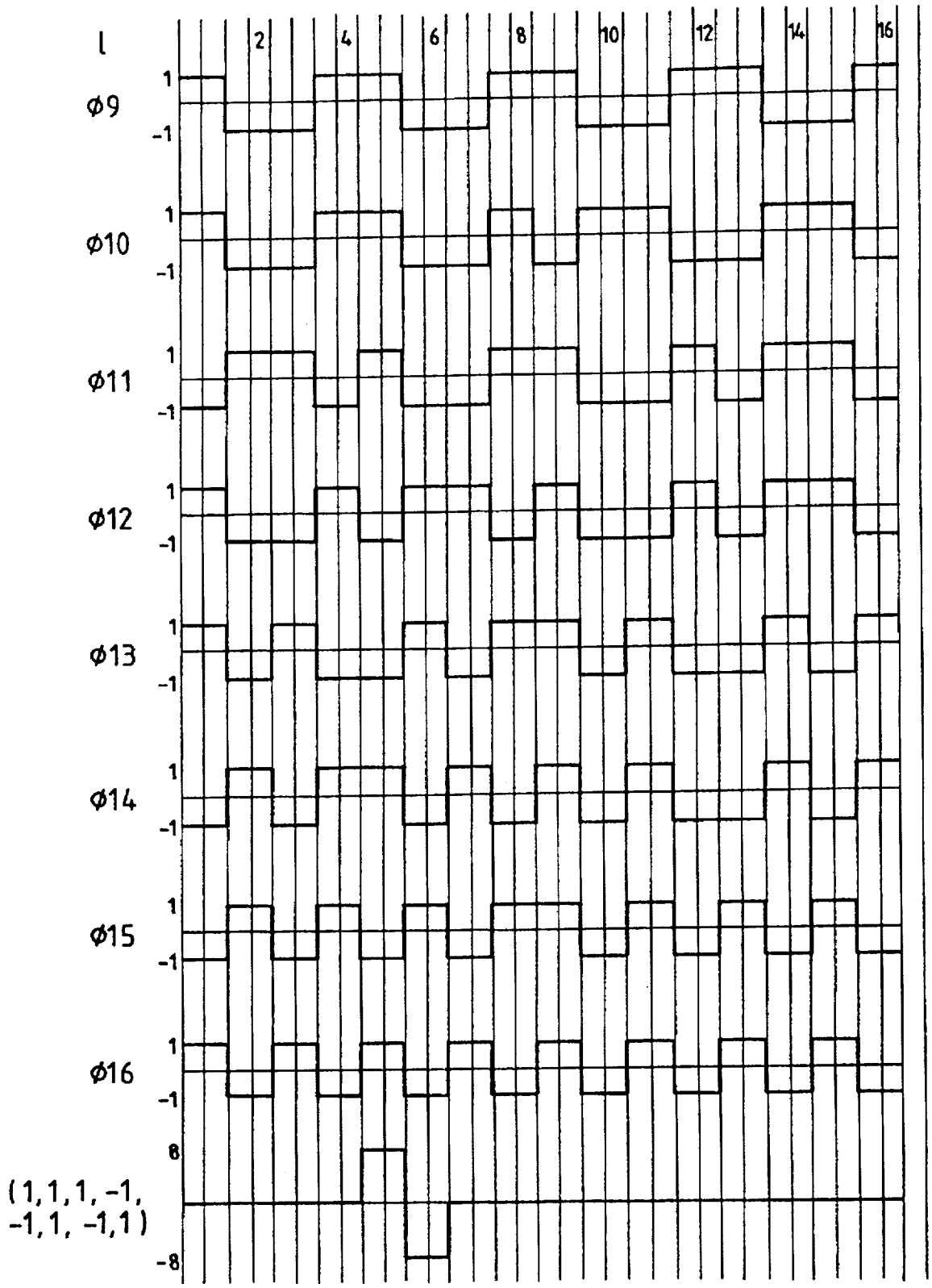
FIG. 6 shows voltage functions having 8 Walsh functions to be applied to the row electrodes in number of 8 with one frame cycle T including 16 intervals.
Figure 7:
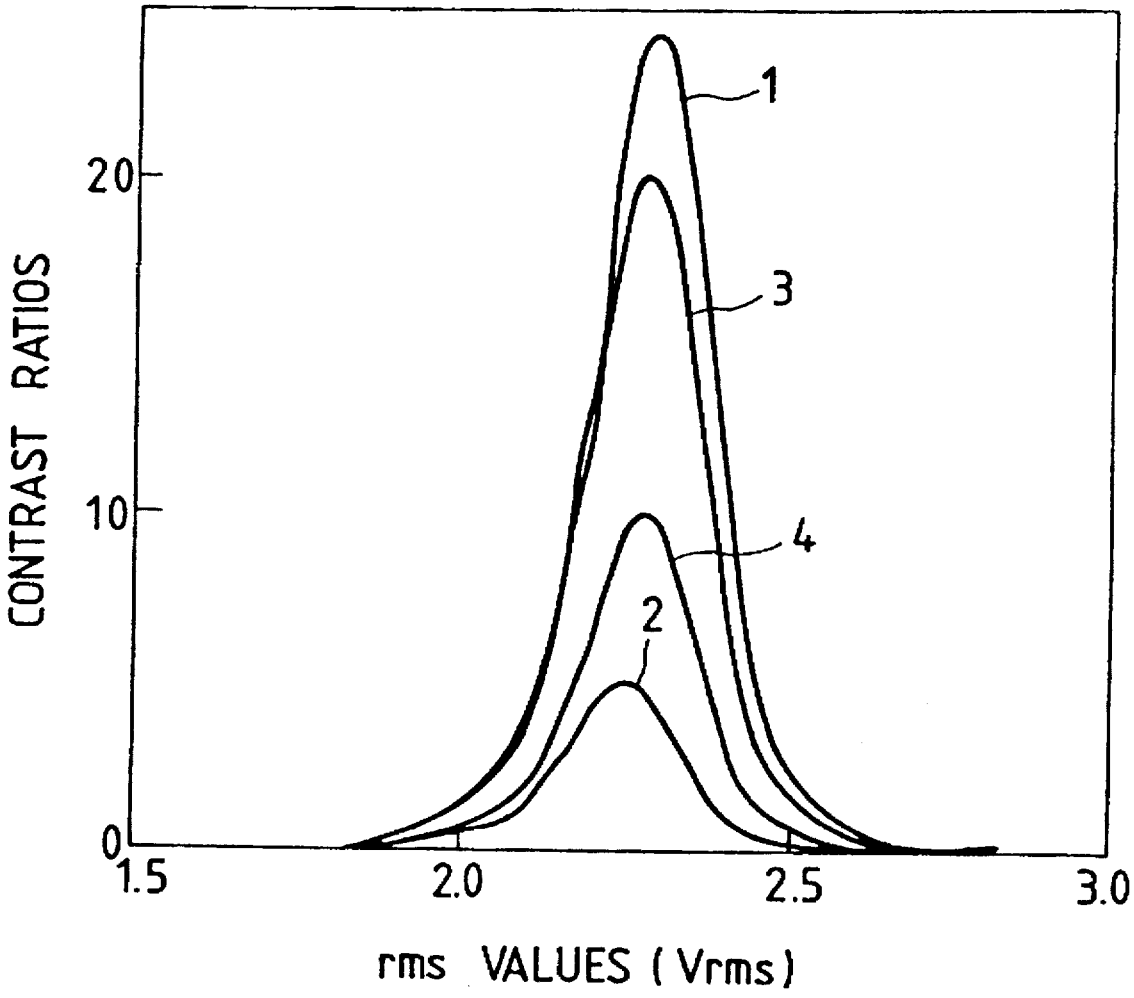
FIG. 7 shows relationships between rms values of applied voltages and resultant display contrast ratios when a single Walsh function was used as a row function.

1 . . . relationship between rms values of applied voltages and contrast ratios according to static driving, 2 . . . relationship between rms values of applied voltages and contrast ratios according to line-sequential driving, 3 . . . relationship between rms values of applied voltages and contrast ratios When driven by a single Walsh function waveform (where a correlation between a display pattern and a row function was small), 4 . . . relationship between rms values of applied voltages and contrast ratios when driven by a single Walsh function waveform (where a correlation between a display pattern and a row function was large), 5 . . . display data, 6 . . . write means, 7 . . . A data, 8 . . . B data, 9 . . . line memory A, 10 . . . line memory B, 11 . . . read-out data A, 12 . . . read-out data B, 13 . . . read means, 14 . . . line X display data, 15 . . . computing means, 16 . . . function generating means, 17 . . . line X function data, 18 . . . computed data, 19 . . . voltage converter means, 20 . . . analog display data, 21 . . . column signal generating means, 22 . . . column electrode drive means, 23–25 . . . column electrode signals each corresponding to the first column electrode signal, the second column electrode signal and the eighth column electrode signal, 26 . . . row function data, 28 . . . row electrode drive means, 29–31 . . . row electrode signals each corresponding to the first row electrode signal, the second electrode signal, and the eighth electrode signal, 32 . . . 8 rows by 8 columns matrix liquid crystal display panel, 33 . . . relationship between rms values of applied voltages and contrast ratios when each row was driven by a waveform of a sum of three Walsh functions in particular where a correlation between the display pattern and the row function was small, 34 . . . relationship between rms values of applied voltages and contrast ratios when each row was driven by a waveform of a sum of three Walsh functions in particular where a correlation between the display pattern and the row function was large, 35 . . . relationship between rms values of applied voltages and contrast ratios when each row was driven by a waveform of a sum of four Walsh functions in particular where a correlation between the display pattern and the row function was small, 36 . . . relationship between rms values of applied voltages and contrast ratios when each row was driven by a waveform of a sum of four Walsh functions in particular where a correlation between the display pattern and the row function was large, 37 . . . display data, 38 . . . write means, 39 . . . A data, 40 . . . B data, 41 . . . line memory A, 42 . . . line memory B, 43 . . . read-out data A, 44 . . . read-out data B, 45 . . . read means, 46 . . . line X display data, 47 . . . computing means, 48 . . . function generator means, 49 . . . line X function data, 50 . . . computed data, 51 . . . voltage converter means, 52 . . . analog display means, 53 . . . relationship between rms values of applied voltages and contrast ratios when each row was driven by a sum of three Walsh functions in particular where its display pattern was composed only of (00) or (11) and having a small correlation with the row function, 54 . . . relationship between rms values of applied voltages and contrast ratios when each row was driven by a sum of three Walsh functions in particular where its display pattern was composed only of (00) or (11) and having a large correlation with the row function, 55 . . . relationship between rms values of applied voltages and contrast ratios when each row was driven by a sum of three Walsh functions in particular where its display pattern includes (10),(01) and its correlation with the row function is large, 56 . . . relationship between rms values of applied voltages and contrast ratios when each row was driven by a sum of three Walsh functions in particular where coefficients $b_k(i,j)$ were interchanged one another for every frame, 57 . . . time-dependent transmission characteristics of the liquid cell when an rms voltage value time-dependent waveform represented by broken lines in FIG. 17 was applied, 58 . . . time-dependent transmission characteristics of the liquid cell when an rms voltage value time-dependent waveform represented by a solid line in FIG. 17 was applied, 59 . . . relationship between rms values of applied voltages and contrast ratios when each row was driven by a waveform of a sum of four Walsh functions and in particular where its display pattern was composed only of (000) or (111) and having a small correlation with the row function, 60 . . . relationship between rms values of applied voltages and contrast ratios when each row was driven by a waveform of a sum of four Walsh functions and in particular where its display pattern was composed only of (000) or (111) and having a large correlation with the row function, 61 . . . relationship between rms values of applied voltages and contrast ratios when each row was driven by waveform of a sum of four Walsh functions and in particular where its display pattern includes (110),(101),(100),(011),(010) or (001) and has a large correlation with the row function, and 62 . . . relationship between rams values of applied voltages and contrast ratios when each row was driven by a waveform of a sum of four Walsh functions in particular where coefficients $b_k(i,j)$ were interchanged one another for every frame.

PREFERRED EMBODIMENTS

[Example 1]

Figure 8:
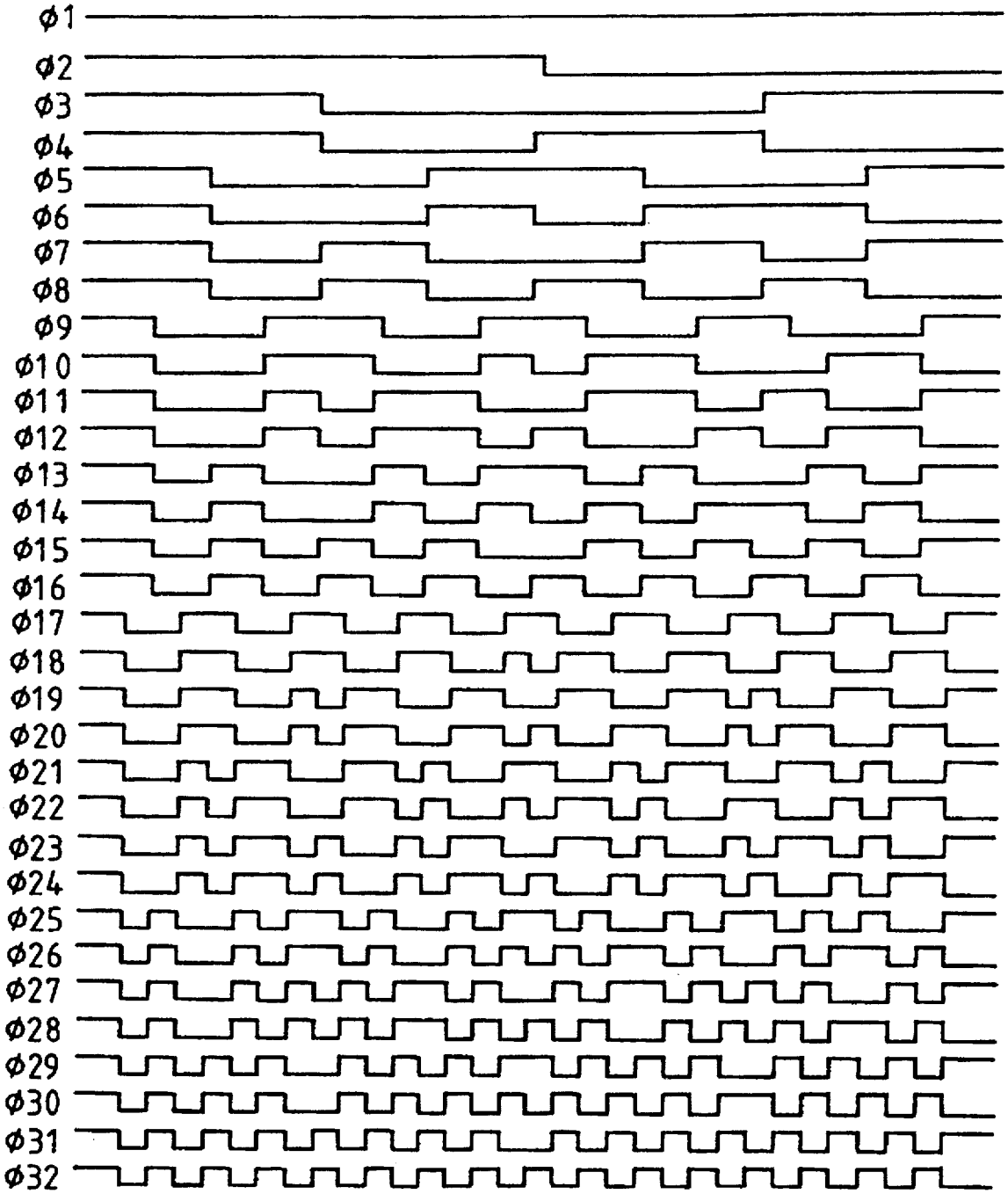
FIG. 8 shows orthogonal functions 1 through 32, so-called Walsh functions.
Figure 9:
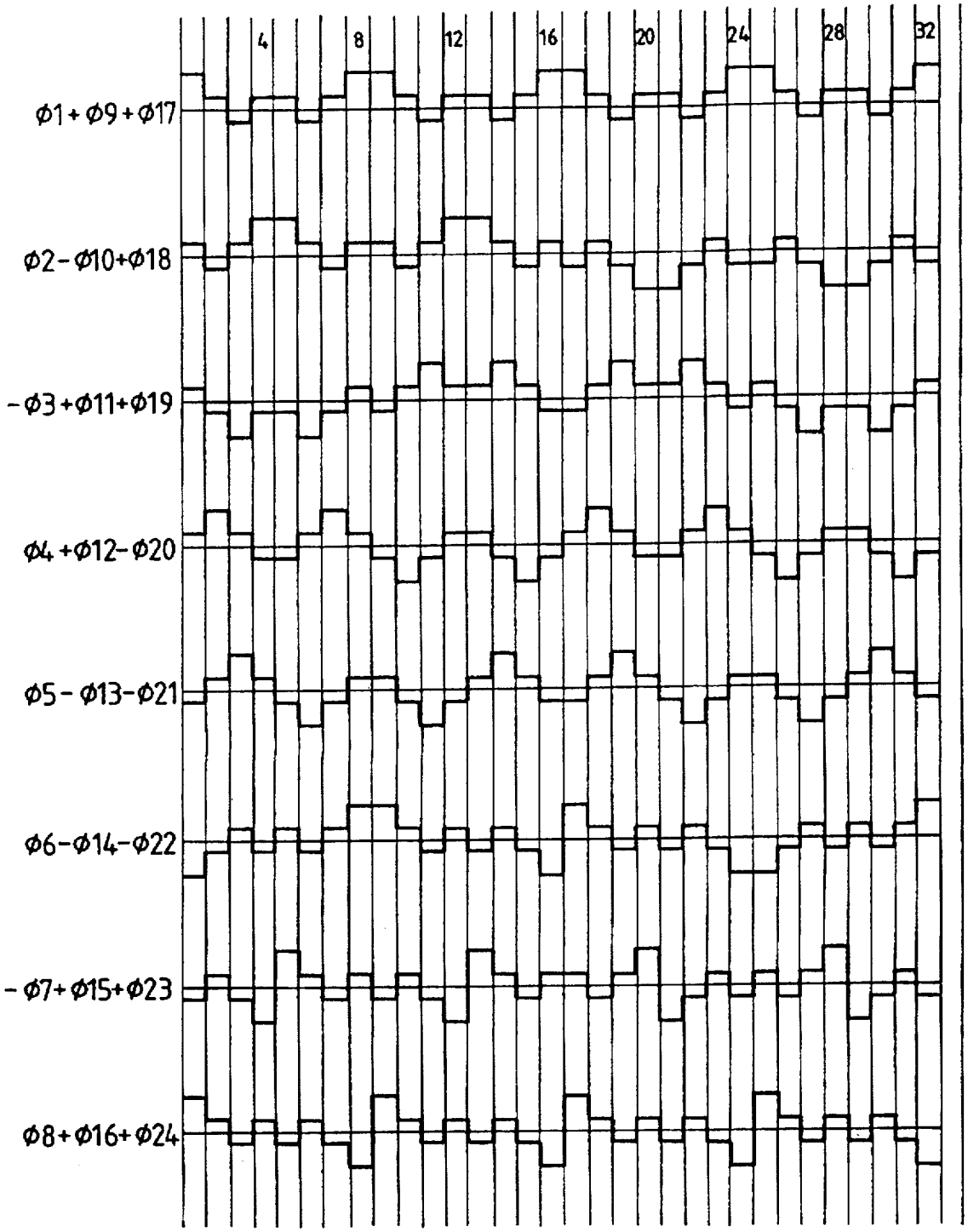
FIG. 9 is a diagram illustrative of respective voltage functions to apply to respective row electrodes in number of 8 row electrodes in which each of the respective voltage functions is made up by a sum of three Walsh functions, with one frame cycle T including 32 intervals.

With reference to the accompanying drawings one example of the present invention will be described in detail in the following. FIG. 1 is a block diagram of a liquid crystal display device of one embodiment of the invention. It would be helpful to discuss about voltage waveforms to be applied to the liquid crystals before proceeding with an explanation of the operation of the liquid crystal. One frame cycle T is defined to comprise 32 small intervals $t_l$(l=1, 2, . . . , 32). In order to compose voltage functions to supply to row electrodes with 8 rows, 24 functions out of a set of 32 Walsh functions which are shown in FIG. 8 are selected and used. With reference to FIG. 9, as a row function $f(1,t_1)$ to supply to a first row a sum of Walsh functions of $\phi 1$, $\phi 9$ and $\phi 17$ shown in FIG. 8, i.e., (ϕ1+ϕ9+ϕ17), is used, then for subsequent respective rows there are used such functions as follows: ϕ2−ϕ10+ϕ18, −ϕ3+ϕ11+ϕ19, ϕ4+ϕ12−ϕ20, ϕ5−ϕ13−ϕ21, −ϕ6−ϕ14−ϕ22, −ϕ7+ϕ15−ϕ23, and ϕ8+ϕ16+ϕ24. A relationship among row numbers, $B_k(i, tl)$, and $a_k(i)$ defining $f(i,t_1)$ is shown in Table 1. A sum of squares of weighted values of respective functions are assumed to be 3. As in the prior art, the liquid display portion of the embodiment is assumed to have an 8 row by 8 column display area.

TABLE 1

| i | $B_1(i,t_1)$ | $B_2(i,t_1)$ | $B_3(i,t_1)$ | $a_1(i)$ | $a_2(i)$ | $a_3(i)$ |
|---|---|---|---|---|---|---|
| 1 | ϕ1 | ϕ9 | ϕ17 | 1 | 1 | 1 |
| 2 | ϕ2 | ϕ10 | ϕ18 | −1 | 1 | 1 |
| 3 | ϕ3 | ϕ11 | ϕ19 | 1 | −1 | 1 |
| 4 | ϕ4 | ϕ12 | ϕ20 | 1 | 1 | −1 |
| 5 | ϕ5 | ϕ13 | ϕ21 | −1 | −1 | −1 |
| 6 | ϕ6 | ϕ14 | ϕ22 | −1 | −1 | 1 |
| 7 | ϕ7 | ϕ15 | ϕ23 | −1 | 1 | −1 |
| 8 | ϕ8 | ϕ16 | ϕ24 | 1 | 1 | 1 |

In this case, a voltage function to be applied to a row electrode and one to be applied to a column electrode are expressed by the following equations (14) and (15), respectively.

$$f(i,t_1) = C_P \sum_{k=1}^{K} a_k(i) B_k(i,t_1) \quad \text{eq. (14)}$$

$$g(j,t_1) = \frac{C_p}{\sqrt{N}} \sum_{i=1}^{N} \sum_{k=1}^{N} b_k(i,j) B_k(i,t_1) \quad \text{eq. (15)}$$

Where, $C_P$ is a constant which is given by equation (16), and $B_k(i,tl)$ is a function shown in FIG. 9.

$$C_P = \sqrt{\frac{\sqrt{N}}{2K(\sqrt{N}-1)}} \quad \text{eq. (16)}$$

Figure 10:
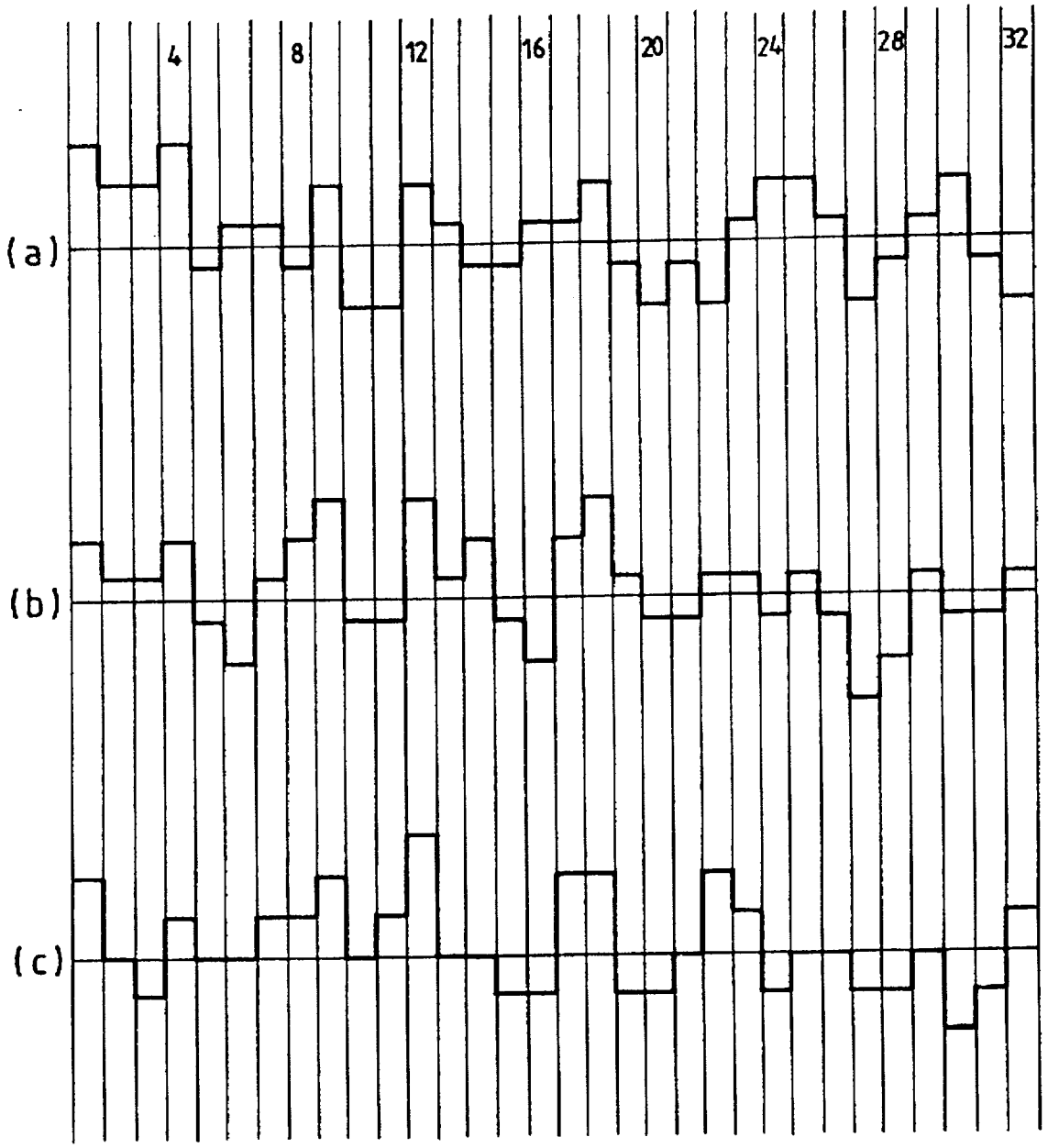
FIG. 10 shows examples of voltage functions applied to a column electrode when each row was driven by a waveform made up by a sum of three Walsh functions.

Further, as in the prior art, P(i,j) in this embodiment becomes −1 when a dot on row i and column j is in the on-state, and 1 when it is in the off-state. Three constants $b_k(i,j)$ which weigh each of three $B_k(i,t_l)$ out of 24 Walsh functions $B_k(i',t_1)$ used to produce a column signal to be applied to the j-th column electrode are defined as a product of $a_k(i)$ and P(i,j) in this embodiment of the invention. When a set of eight elements of a display vector is given by (1, 1, −1, 1, 1, −1, −1, 1), $g(j,t_1)$ takes a waveform as shown in (a) of FIG. 10. When the display vector is (1, 1, 1, 1, 1, 1, −1, 1), it takes a waveform of (b) of FIG. 10, and when the display vector is (1, 1, 1, 1, −1, 1, −1, 1), it takes a waveform of (c) of FIG. 10. As is obvious from these waveforms, biases or deviations in the distribution of waveforms in dependency on the display vectors became smaller compared to when the LCD was driven by the voltage function waveforms according to a single Walsh function.

We have discussed the drive method heretofore by way of example of the 8 row by 8 column matrix display in which each row was driven by a voltage function waveform according to a sum of three Walsh functions. However, it is not limited thereto, and in general a matrix addressing display with N rows by M columns can be driven for each row by a voltage function waveform according to a sum of three Walsh functions to achieve the same effect and advantage of the invention.

Further, we have discussed this embodiment of the invention by way of example of the Walsh functions heretofore, but it is not limited thereto, and any orthogonal function which has a value of 1 or −1 can be adopted in the scope of this invention. Hereinafter, such a drive method will be referred to as a weighted orthogonal function add drive method.

Figure 11:
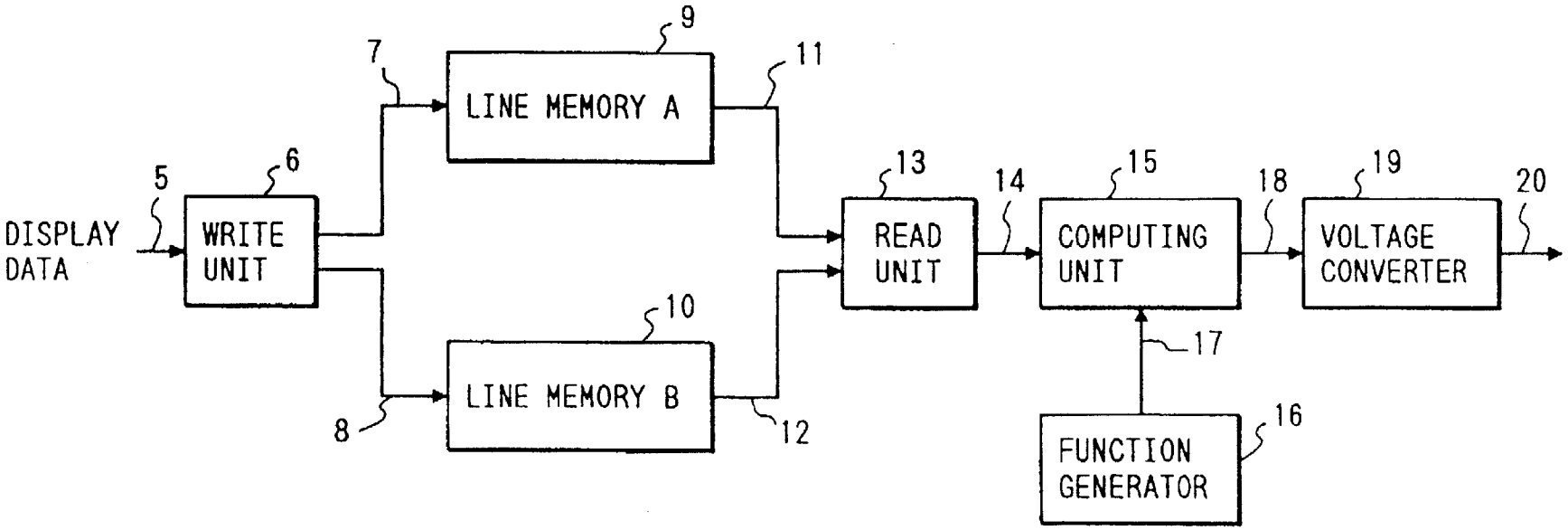
FIG. 11 is a block diagram of a column signal generator means of an example 1 of the invention.

Next, with reference to FIGS. 1, 11 and 12, one embodiment of the invention will be described in detail in the following. FIG. 11 is a block diagram illustrative of a column signal generating unit for implementing an orthogonal function drive method of one embodiment of the invention. Numeral 5 denotes a display data which is indicated by "1" when display is in the on-state and by "−1" when display is in the off-state. 6 is a write-in means, 7 is an A data, 8 is a B data, 9 is a line memory for storing data corresponding to 8 rows, and 10 is a line memory for storing data corresponding to 8 rows. The write means 6 writes in a display data 5 corresponding to a period $t_l$ as A data 7 into the line memory A 9, then writes in a display data 5 corresponding to a subsequent period $t_{1+1}$ as B data 8 in the line memory B 10. In this way, the write means 6 writes data of 8 rows alternatively into the line memories A 9 and B 10 respectively. Numeral 11 is a read data A, 12 is a read data B, 13 is a read means. The read means 13 is adapted to read out data stored via a read data A 11 or a read data B 12 from either the line memories A 9 or B 10 whichever in the absence of writing. By way of example, in this read operation, data corresponding to 8 rows are simultaneously read out.

Numeral 14 denotes a piece of display information which is read out from the line memories by the read means 13, and which contains an 8 row display data. 15 is a computing means, 16 is a function generating means, 17 is an 8 row function data which has a voltage function waveform according to a sum of three Walsh functions. The computing means 15 calculates a sum of products of the 8 row display data 14 which is display information and the 8 row function data 17. 18 is a computed data, 19 is a voltage converter means, and 20 is an analog display data which was converted from the computed data 18 output from the computing means 15 by the voltage converting means. With reference to FIG. 1 illustrative of the liquid crystal display device of one embodiment of the invention, numeral 21 depicts the column signal generating means which has been described in FIG. 11, and numeral 22 which is a column electrode drive means takes in a column signal data for one unit line, then outputs the above data for the one unit line concurrently. By way of example, this entry of the one column data is performed according to each unit interval. Numerals 23 through 25 denote respective column electrode signals to a first column, a second column, and the eighth column.

26 depicts a row function generating means which generates as a row function a voltage function waveform according to a sum of three Walsh functions as shown in FIG. 9. 27 is a row function data, 28 is a row electrode drive means, and the row function generating means 26 writes a set of functions for each of the 8 rows for a unit time interval into the row electrode drive means 28 via the row function data 27, then the row electrode drive means 28 upon completion of writing of the data outputs a voltage in dependency on the data to the row electrode. Further, writing of the row function data 27 is also performed according to a unit time interval in synchronization with a cycle of the unit time interval at which the analog display data 20 is written by the column electrode drive means 22. Numerals 29 through 31 depict row electrode signals to be applied to the first row, the second row, and the eighth row, respectively. Finally, 32 depicts an 8 row by 8 column matrix addressing liquid crystal display panel.

Figure 12:
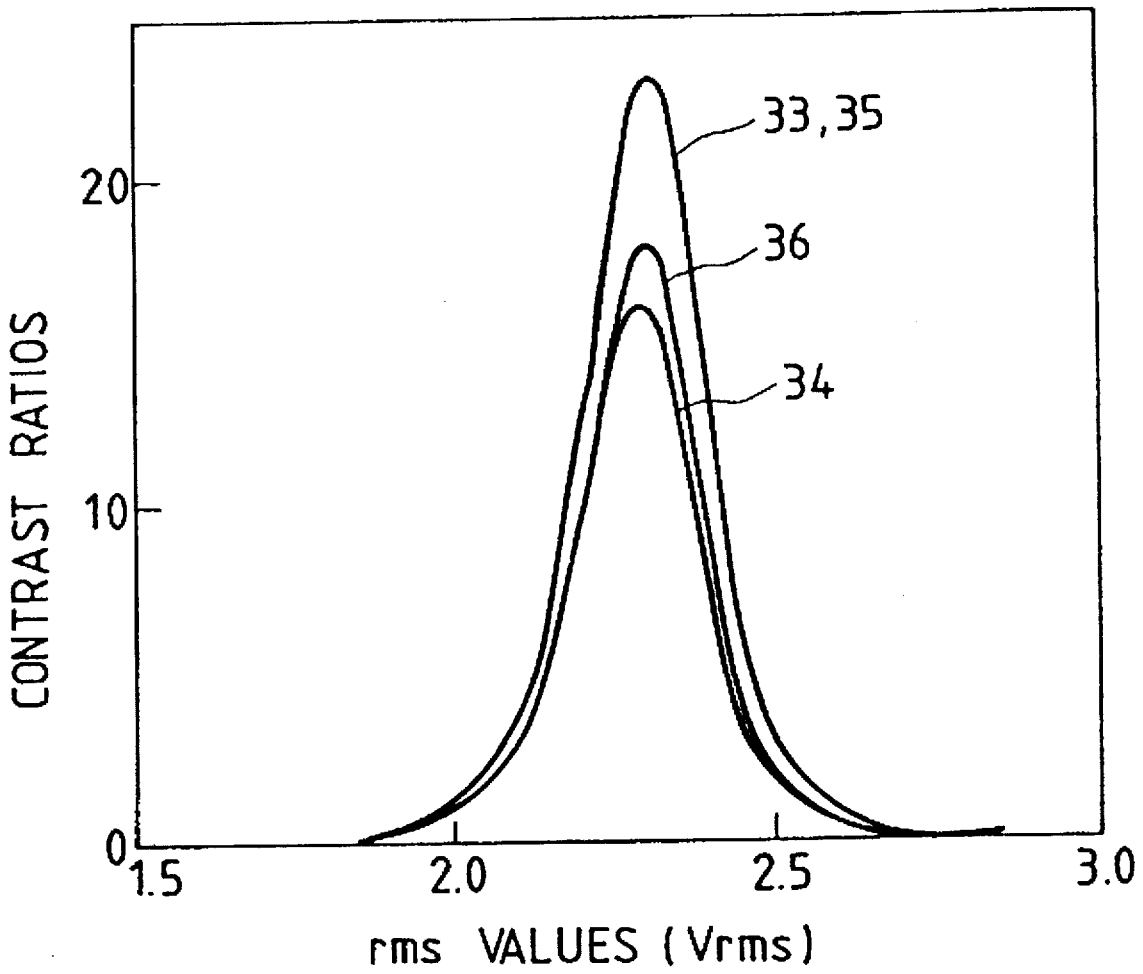
FIG. 12 is a diagram illustrative of relationships between rms values of applied voltages and resultant display contrast ratios when each row was driven by a sum of three Walsh functions.

In this embodiment of the invention, a liquid crystal panel having the same construction as in the prior art was used to measure a relationship between rms values of applied voltages and contrast ratios thus obtained, the result of such measurements is shown in FIG. 12. A curve 33 depicts an example obtained when its display pattern had a small correlation with scanning vectors, the maximum contrast of which was as large as 23. A curve 34 depicts an example obtained when its display pattern had a large correlation with the scanning vectors, the maximum contrast of which was 16. In comparison with such a case where a voltage function waveform according to one Walsh function was applied to each row, the dependency of contrast on the display patterns has been improved to approximately 0.7 according to the invention. Further, when we applied a display vector consisting of (1, −1, 1, −1, 1, −1, 1, 1) to the first column, and another display vector consisting of (1, 1, 1, −1, −1, 1, −1, 1) to the third column on the liquid crystal panel, a ratio of brightness Br(4, 1) and Br(4 ,3) on the fourth column in the off-state, i.e., Br(4,1)/Br(4,3) became 0.8 in this embodiment according to the invention whereas it was 0.6 when a waveform according to one Walsh function was applied, thereby confirming that the cross talk has been suppressed substantially.

As stated above, with the same construction as the prior art which is driven by the voltage function waveform according to a single Walsh function, it has been enabled substantially to suppress the cross talk and lowering of contrasts in the fast responding liquid crystal cells by adopting the drive method according to the present invention.

[Example 2]

Figure 13:
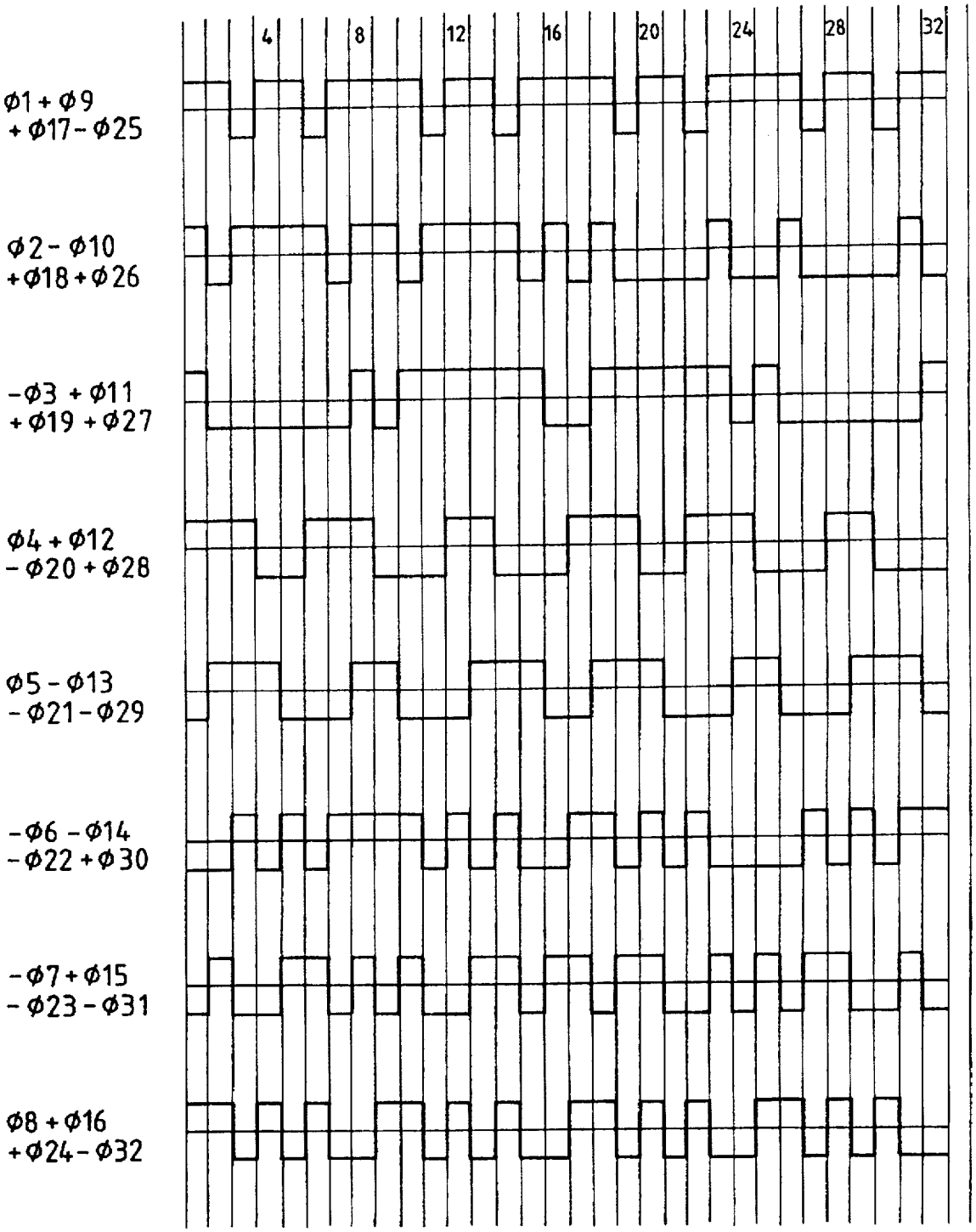
FIG. 13 is a diagram illustrative of respective voltage functions to be applied to respective row electrodes in number of 8 in which each of the respective voltage functions to be applied to each row is made up by a sum of four Walsh functions, with one frame cycle T including 32 intervals.

Another example of the present invention will be set forth in the following. In order to compose each voltage function to apply to each of 8 row electrodes, 32 functions of a set of Walsh functions shown in FIG. 8 were selectively combined. For example, as shown in FIG. 13, to provide a row function to be applied to the first row $f(1,t_l)$, a sum of $\phi1$, $\phi9$, $\phi17$ and $-\phi25$, i.e., $(\phi1+\phi9+\phi17-\phi25)$, which are Walsh functions of FIG. 8, was used. For the other subsequent rows of the 8 row electrodes, the following combinations are used respectively: $\phi2-\phi10+\phi18+\phi26$, $-\phi3+\phi11+\phi19+\phi27$, $\phi4+\phi12-\phi20+\phi28$, $\phi5-\phi13-\phi21-\phi29$, $-\phi6-\phi14-\phi22+\phi30$, $-\phi7+\phi15-\phi23-\phi31$, $\phi8+\phi16+\phi24-\phi32$. A relationship among row numbers, $B_k(i,t_1)$, and $a_k(i)$ defining $f(i,t_1)$ is shown in Table 2. Here, a sum of squares of weighted values of respective functions is assumed to be 4. Further, a liquid crystal display portion is assumed to be an 8 row by 8 column matrix display as in the prior art.

TABLE 2

| i | $B_1(i,t_1)$ | $B_2(i,t_1)$ | $B_3(i,t_1)$ | $B_4(i,t_1)$ | $a_1(i)$ | $a_2(i)$ | $a_3(i)$ | $a_4(i)$ |
|---|---|---|---|---|---|---|---|---|
| 1 | $\phi1$ | $\phi9$ | $\phi17$ | $\phi25$ | 1 | 1 | 1 | −1 |
| 2 | $\phi2$ | $\phi10$ | $\phi18$ | $\phi26$ | −1 | 1 | 1 | 1 |
| 3 | $\phi3$ | $\phi11$ | $\phi19$ | $\phi27$ | 1 | −1 | 1 | 1 |
| 4 | $\phi4$ | $\phi12$ | $\phi20$ | $\phi28$ | 1 | 1 | −1 | 1 |
| 5 | $\phi5$ | $\phi13$ | $\phi21$ | $\phi29$ | −1 | −1 | −1 | −1 |
| 6 | $\phi6$ | $\phi14$ | $\phi22$ | $\phi30$ | −1 | −1 | 1 | 1 |
| 7 | $\phi7$ | $\phi15$ | $\phi23$ | $\phi31$ | −1 | 1 | −1 | −1 |
| 8 | $\phi8$ | $\phi16$ | $\phi24$ | $\phi32$ | 1 | 1 | 1 | −1 |

Figure 14:
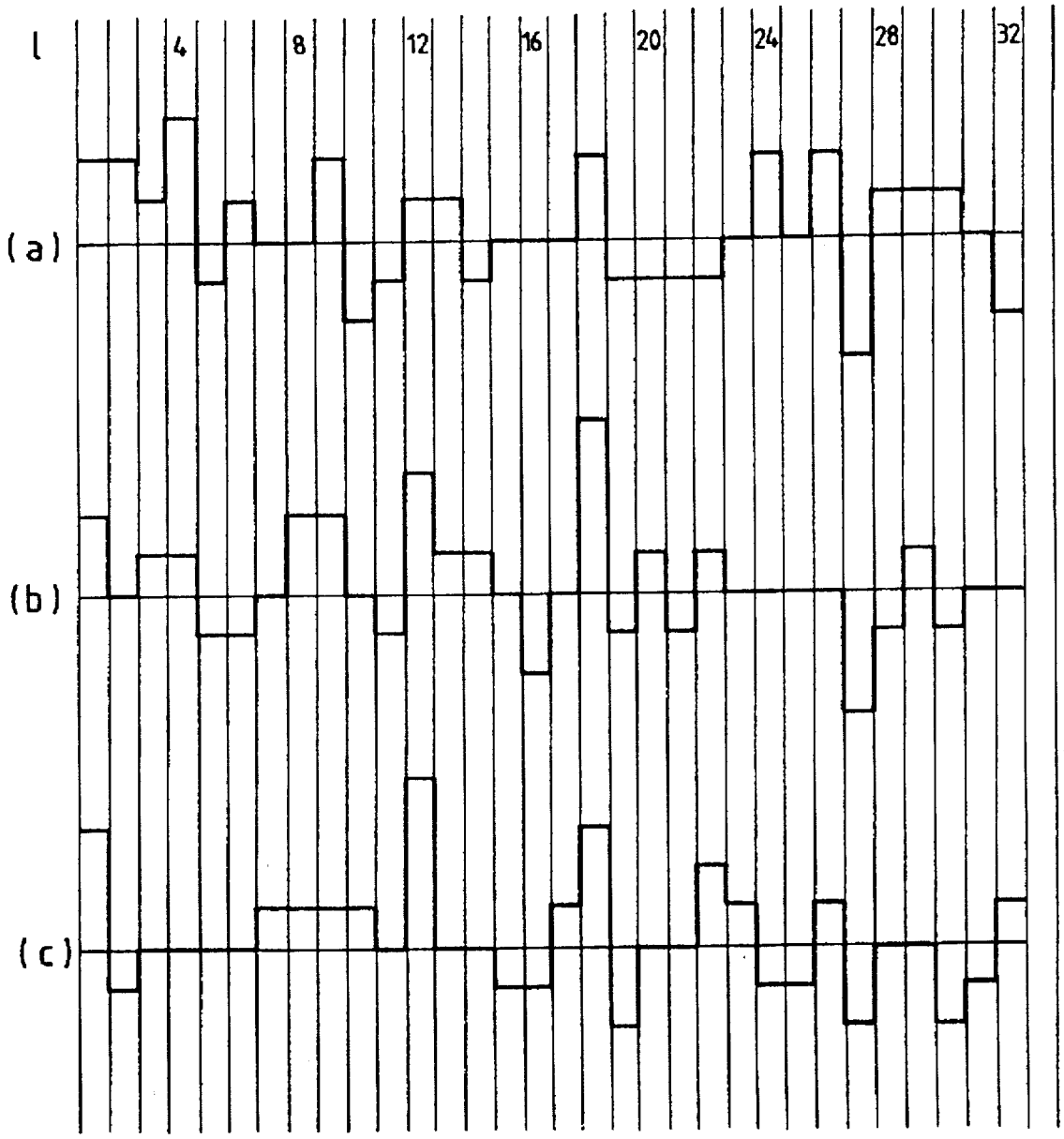
FIG. 14 shows examples of a voltage function to be applied to a column electrode when each row was driven by a sum of four Walsh functions.

A computing method for computing a voltage function waveform to apply to each column electrode and an arrangement of the device of the example 2 of the invention are the same as those in the example 1. When eight elements in a display vector are given by (1, 1, −1, 1, 1, −1, −1, 1), $g(j,t_1)$ assumed a waveform as shown in (a) of FIG. 14, when the display vector is given by (1, 1, 1, 1, 1, 1, −1, 1), it assumed a waveform of (b) of FIG. 14, and when the display vector is (1, 1, 1, 1, −1, 1, −1, 1), it assumed a waveform of (c) of FIG. 14, thereby indicating that the dependency of waveforms on the display patterns advantageously decreased compared to when the voltage function waveform according to a single Walsh function was applied to each row of the LCD according to the prior art.

Likewise, with regard to the example 2 of the invention, a relationship between the rms values of applied voltages and resultant contrast ratios was measured using a liquid crystal panel with the same construction as the prior art panel. In reference to FIG. 12, a curve 35 plots contrast ratios for particular display patterns having small correlation with scanning vectors and the maximum contrast of which was 23. A curve 36 is for display patterns having a larger correlation with the scanning vectors, and the maximum contrast of which was 18. The dependency of contrast on the display patterns has improved and decreased to a half according to the drive method of the invention compared to when the voltage function waveform according to a single Walsh function was applied to each row of the LCD. Further, when we applied a display vector consisting of (1, −1, 1, −1, 1, −1, 1, 1) to the first column, and a display vector consisting of (1, 1, 1, −1, −1, 1, −1, 1) to the third column, a ratio of brightness Br(4,1) and Br(4,3) on the fourth row in the off-state of display in the example 2 of the invention has improved, i.e., Br(4,1)/Br(4,3)=0.85, in contrast, while it was 0.6 when the waveform according to the single Walsh function was applied, thereby indicating a substantial suppression in the cross talk to have been implemented.

As described hereinabove, according to the example 2 of the invention which comprises the same construction as the prior art LCD to be driven by the voltage function waveform based on a single Walsh function, it has been possible to suppress the cross talk as well as the degradation in contrast when applied to the fast responding liquid crystal cells.

[Example 3]

Still another embodiment of an example 3 according to the invention will be set forth in the following. With respect to a voltage waveform to apply to a liquid crystal display, one frame cycle T is defined to include 32 small intervals $t_1$(l=1, 2, . . . , 32), and a voltage function to apply to each of 8 row electrodes is defined to be the same as one specified in the example 1 of the invention. Likewise, its display portion is also specified to be the same as in the example 1.

In this example 3 of the invention, display information P(i,j) includes two bits, which in accordance with a particular gradation that a dot on row i and column j is to display assumes one of four sets of values such as (00) for a first gradation, (01) for a second gradation, (10) for a third gradation, and (11) for a fourth gradation. In Table 3, among functions for defining $g(j,t_1)$, there are shown functions of coefficients $b_1(i,j)$, $b_2(i,j)$ and $b_3(i,j)$ related to three functions $B_1(i,t_1)$, $B_2(i, t_1)$ and $B_3(i,t_1)$ which pertain to P(i,j).

TABLE 3

| Gradation Levels | P(i,j) | $b_1(i,j)$ | $b_2(i,j)$ | $b_3(i,j)$ |
|---|---|---|---|---|
| 4 | 11 | $-a_1(i)$ | $-a_2(i)$ | $-a_3(i)$ |
| 3 | 10 | $a_1(i)$ | $-a_2(i)$ | $-a_3(i)$ |
| 2 | 01 | $-a_1(i)$ | $a_2(i)$ | $a_3(i)$ |
| 1 | 00 | $a_1(i)$ | $a_2(i)$ | $a_3(i)$ |

It will be demonstrated in the following by utilizing equations (14) through (16) and computing an rms value of voltage Urms(i,j) for $U(i,j)(f(i,t_1)-g(j,t_1)$ that a gradation display becomes possible by $b_1(i,j)$, $b_2(i,j)$ and $b_3(i,j)$. Where, since $T=m_t \cdot t_1$, by computing respective terms as a sum with respect to 1, we obtain, $$U^2rms(i,j) = \frac{1}{T}\int_0^T |f(i,t_1)-g(j,t_1)|^2 dt$$

$$= \frac{1}{T}\int_0^T \{f^2(i,t_1)+g^2(j,t_1)-2f(i,t_1)g(j,t_1)\}dt$$

$$\frac{1}{T}\int_0^T |f(i,t_1)|^2 dt = \frac{C_p^2}{m_t}\sum_{l=1}^{mt}\left\{\sum_{k=1}^{K} a_k(i)B_k(i,t_1)\right\}^2$$

$$= \frac{C_p^2}{m_t}\sum_{k=1}^{K} a_k^2(i)\cdot m_t = \frac{\sqrt{N}}{2(\sqrt{N}-1)}$$

$$\frac{1}{T}\int_0^T g^2(j,t_1)dt = \frac{C_p^2}{m_t}\sum_{l=1}^{m_t}\left[\frac{1}{\sqrt{N}}\sum_{i'=1}^{N}\sum_{k=1}^{K} b_k(i',j)B_k(i',t_1)\right]^2$$

$$= \frac{C_p^2}{m_t}\cdot\frac{1}{N}\cdot\sum_{l=1}^{m_t}\left(\sum_{i'=1}^{N}\sum_{k=1}^{K} b_k^2(i',j)\right)$$

$$= \frac{C_p^2}{m_t}\ \frac{1}{N}\cdot N\cdot m_t\cdot k = \frac{\sqrt{N}}{2(\sqrt{N}-1)}$$

$$\frac{2}{T}\int_0^T f(i,t_1)g(j,t_1)dt = \frac{2C_p^2}{m_t}\sum_{l=1}^{m_t}\left(\sum_{k=1}^{K} a_k(i)B_k(i,t_1)\right)\cdot\left(\frac{1}{\sqrt{N}}\sum_{i'=1}^{N}\sum_{k=1}^{K} b_k(i',j)B_k(i',t_1)\right)$$

$$= \frac{2C_p^2}{m_t\sqrt{N}}\cdot m_t\sum_{k=1}^{K} a_k(i)\cdot b_k(i,j)$$

$$= \frac{2C_p^2}{\sqrt{N}}\sum_{k=1}^{K} a_k(i)b_k(i,j) = \frac{1}{K(\sqrt{N}-1)}\sum_{k=1}^{K} a_k(i)b_k(i,j)$$

$$U^2_{rms}(i,j) = \frac{\sqrt{N}}{2(\sqrt{N}-1)}+\frac{\sqrt{N}}{2(\sqrt{N}-1)}-\frac{1}{K(\sqrt{N}-1)}\sum_{k=1}^{K}(a_k(i)b_k(i,k))$$

$$= \frac{1}{\sqrt{N}-1}\left[\sqrt{N}-\frac{1}{K}\sum_{k=1}^{K}(a_k(i)b_k(i,j))\right]$$

Where, since N=8 and K=3, we obtain, $$Urms^2(i,j) = \frac{1}{2\sqrt{2}-1}\cdot\left[2\sqrt{2}-\frac{1}{3}(a_1(i)b_1(i,j)+a_2(i)\cdot b_2(i,j)+a_3(i)\cdot b_3(i,j))\right] \quad \text{eq. (17)}$$

Thereby, the rms value of voltage is consequently given by equation (17), and by arranging such that $b_1(i,j)$, $b_2(i,j)$ and $b_3(i,j)$ assume a value of +1 or −1 in combination as shown in Table 1, it has been indicated that Urms(i,j) will assume four levels of values as expressed by the following equations (18) through (21), and that gradation displays of four levels are thus implemented.

When $b_k(i,j)=-a_k(i)$(where, k=1~3), $$Urms_4^2(i,j) = \frac{1}{2\sqrt{2}-1}\left[2\sqrt{2}+\frac{1}{3}\times 3\right] = \frac{2\sqrt{2}+1}{2\sqrt{2}-1} \quad \text{eq. (18)}$$

When $b_1(i,j)=-a_1(i)$, $b_2(i,j)=-a_2(i)$, $b_3(i,j)=a_3(i)$, $$Urms_3^2(i,j) = \frac{1}{2\sqrt{2}-1}\left[2\sqrt{2}+\frac{1}{3}\right] = \frac{6\sqrt{2}-1}{3(2\sqrt{2}-1)} \quad \text{eq. (19)}$$

When $b_1(i,j)=-a_1(i)$, $b_2(i,j)=a_2(i)$, $b_3(i,j)=a_3(i)$, $$Urms_2(i,j) = \frac{1}{2\sqrt{2}-1}\left[2\sqrt{2}-\frac{1}{3}\right] = \frac{6\sqrt{2}-1}{3(2\sqrt{2}-1)} \quad \text{eq. (20)}$$

When $b_k(i,j)=a_k(i)$ (where k=1~3), $$Urms_1(i,j) = \frac{1}{2\sqrt{2}-1}[2\sqrt{2}-1] = 1 \quad \text{eq. (21)}$$

Figure 15:
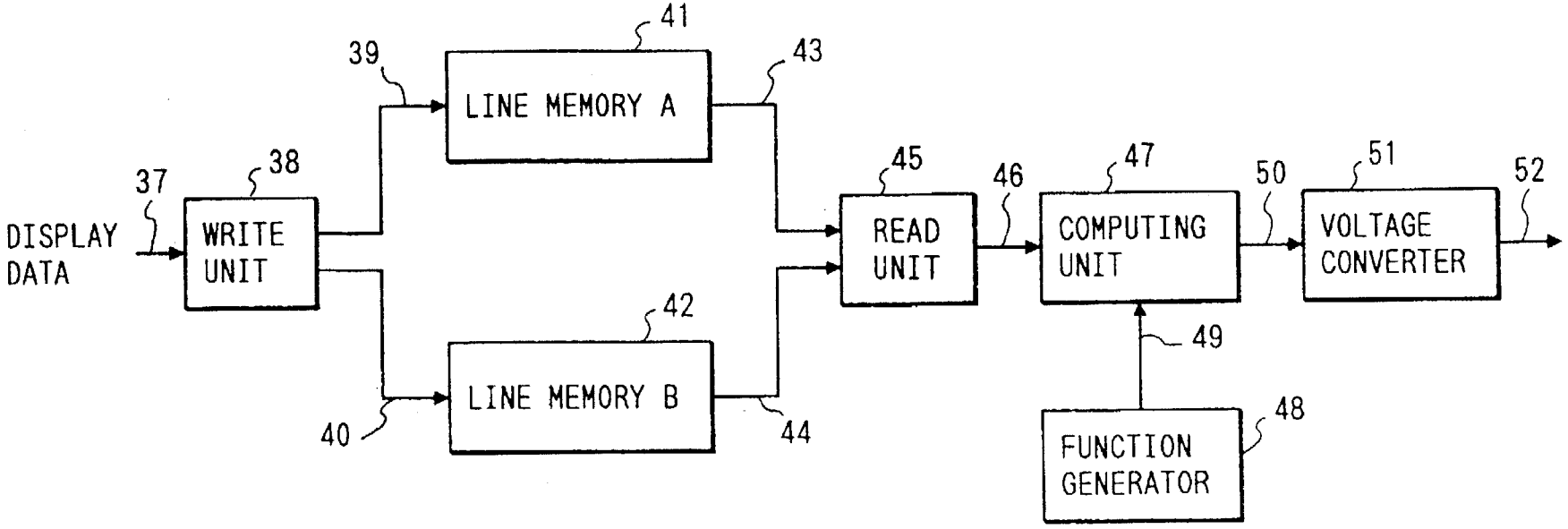
FIG. 15 is a block diagram illustrative of a column signal generator means of the example 3 of the invention for implementing a gradation display by driving each row with a sum of three Walsh functions.
Figure 16:
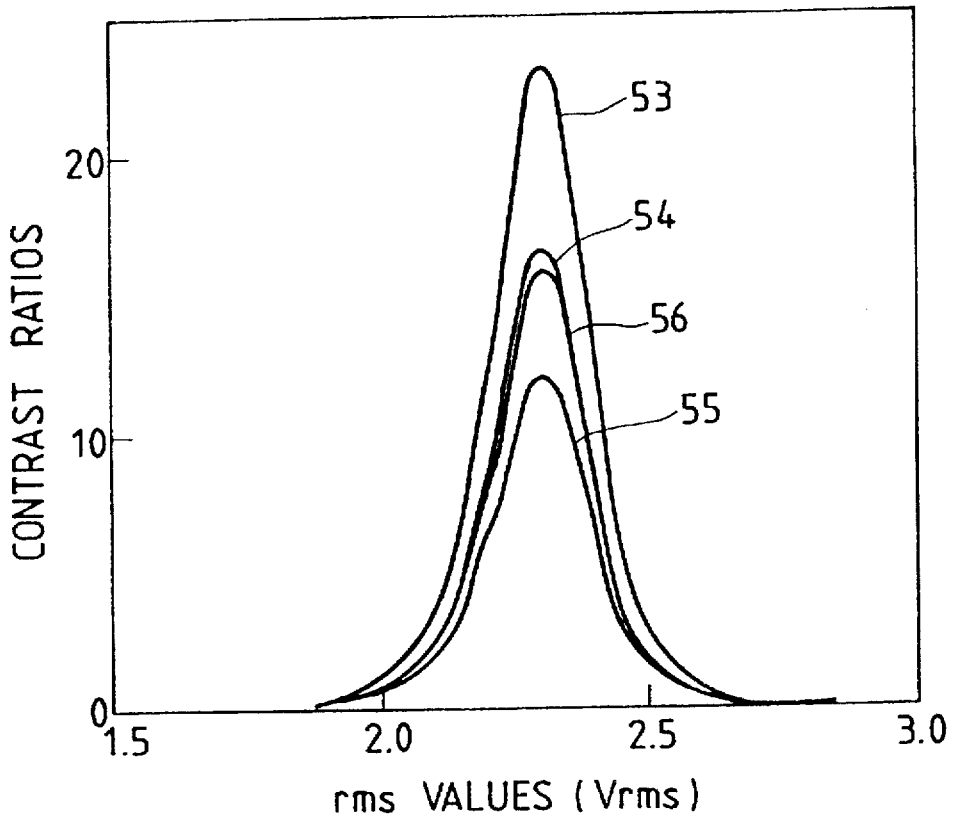
FIG. 16 is a diagram showing relationships between rms values of applied voltages and resultant contrast ratios when each row was driven by a sum of three Walsh functions in order to display gradation patterns.

With reference to FIGS. 1, 15 and 16, a liquid crystal drive circuit of the example 3 of the invention described above will be discussed in detail in the following. FIG. 15 is a block diagram of a column signal generating means for implementing a gradation display by the orthogonal function add drive method according to one embodiment of the invention. Numeral 37 is a display data essentially consisting of two bits, and depending on a particular gradation that an i row by j column dot is to display, can assume either one of four combinations of values of (00) for a first level gradation, (01) for a second level gradation, (10) for a third level gradation, and (11) for a fourth level gradation, for example. 38 depicts a write means, 39 is an A data, 40 is a B data, 41 is a line memory A which stores a gradation display data essentially consisting of two bits and corresponding to a unit of 8 rows, and 42 is a line memory B which stores a data corresponding to a unit of 8 rows. The write means 38 writes a display data 37 for a particular period of time $t_1$ as an A data 39 into the line memory A 41, then it writes a display data 37 for a subsequent period of time $t_{1+1}$ as a B data into the line memory B 42. As stated above, the write means 38 writes a data corresponding to a unit of 8 rows alternatively into the line memory A 41 and the line memory B 42. Numeral 43 is a read-out data A read out from the line memory A, 44 is a read-out data B read out from the line memory B, and 45 is a read means which reads out stored data per bit via a read-out data A or B from whichever line memories A 41 or B 42 that is not in a write-in mode. By way of example, this read operation is performed to read out a data corresponding to a unit of 8 lines simultaneously. 46 is display information read out from the line memories by the read means 45, which includes display data for 8 lines. 47 is a computing means, 48 is a function generating means, and 49 is a function data corresponding to 8 lines in which three voltage function waveforms according to three Walsh functions are read out for each row. The computing means 47 transforms display information including two bits into $b_1(i,j)$, $b_2(i,j)$ and $b_3(i,j)$ according to Table 3, then performs a sum-of-products computation of an 8 line display data 46 with an 8 line function data 49. 50 is a calculated data, 51 is a voltage analog converter means, and 52 is an analog display data which is converted from the calculated data 50 computed in the computing means 47 to a voltage by the voltage analog converter means. FIG. 1 is a block diagram illustrative of a liquid crystal display device which adopted a column signal generating means of one embodiment of the invention of FIG. 15, which operates in the same manner as in the example 1.

Also, with regard to the example 3 of the invention, a relationship between rms values of applied voltages and resultant contrasts has been measured on a similar 8 row by 8 column matrix liquid crystal panel. The result of such measurements is plotted in FIG. 16. In such a case when every P(i,j) of 8 elements of display vectors on column j takes (11) or (00), the same advantageous effects as in the example 1 were obtained as represented by curves 53 and 54. However, in such instances where P(i,j) included (01) and (10) in the 8 elements of display vectors, a resultant contrast between (11) and (00) for its display vectors of P(i,j) is represented by a curve 55, whose maximum contrast dropped to 12. This has been caused to happen due to a deviation in the waveform of $g(j,t_1)$, which occurred since $b_1(i,j)$, $b_2(i,j)$ and $b_3(i,j)$ were changed independently thereof in accordance with P(i,j). When we displayed a pattern by applying a display vector of [(11), (00), (10), (01), (10), (10), (01), (00)] to the first column of the example 3, and a display vector of [(11), (00), (11), (01), (00), (11), (01), (10)] to the third column of the same, a ratio of brightness for a display element on the first row by second column and one on the third row by second column became 0.6, i.e., Br(1,2)/Br(3, 2)=0.6, as against 0.8 obtained at the time when the waveform on the basis of three Walsh functions was applied, thus decreasing the suppression effect for suppressing cross talk. However, according to the example 3 of the invention, a computation of a correction coefficient which was necessary when performing a gradation display according to the amplitude modulation in the conventional orthogonal function drive methods is no more needed. This will be discussed in the following. In the prior art orthogonal function drive methods, a gradation display is implemented by varying P(i,j) of equation (8) between −1 and +1. In this instance, an rms value of a voltage applied to a display element is expressed by equation (22). In the absence of any correction, a sum of $P^2(i,j)$ will affect rms values applied to display elements on column j.

$$Urms^2(i,j) = \left[\frac{\sqrt{N}}{2(\sqrt{N}-1)} + \frac{1}{2(\sqrt{N}-1)}\ \frac{1}{\sqrt{N}}\sum_{i=1}^{N} P^2(i,j) - \frac{2P(i,j)}{2(\sqrt{N-1})}\right] \quad \text{eq. (22)}$$

Thereby, it was necessary in computation of $g(j,t_1)$ as described in JAPAN DISPLAY '92, pp. 503–506, to transform to the following equation (23). In this instance, Urms (i,j) can be given by equation (24).

$$g(j,t_1) = \frac{1}{\sqrt{N}}\sum_{i=1}^{N} P(i,j)\cdot f(i,t_1) + \frac{1}{\sqrt{N}}\ V(N+i,j)f(N+1,t_1) \quad \text{eq. (23)}$$

$$(j = 1\sim M,\quad t = t_1\sim t_{ms})$$

$$\text{where } V(N+1,j) = \sqrt{N - \sum_{i=1}^{N} P^2(i,j)}$$

$$Urms^2(i,j) = \frac{1}{\sqrt{N}-1}\ [\sqrt{N} - P(i,j)] \quad \text{eq. (24)}$$

In contrast to the foregoing, no computation as above is required any more according to the example 3 of the invention, thereby its arithmetic circuit could have been made simpler.

It has been described heretofore by way of example that each row of the 8 row×8 column matrix display was driven by a voltage function waveform based on a sum of three Walsh functions, however, it is not limited thereto, and any matrix display device with N rows×M columns can be driven its each row by a voltage function waveform on the basis of a sum of at least two Walsh functions to simplify its arithmetic circuit. Further, by applying a voltage function waveform on the basis of a sum of at least three Walsh functions to drive each row of the matrix display, cross talk and decreases in contrast when applied to a fast responding liquid crystal cell could have been successfully suppressed.

Although the preferred embodiments of the invention have been described by way of example of the Walsh function, it is not limited thereto, but any orthogonal function can be used so long as it is allowed to have a value of 1 or −1.

[Example 4]

Still another embodiment of the invention, i.e., an example 4 will be described below. Here, when P(i,j) in the example 2 assumed (01) or (10) to display a half tone, each value of $b_1(i,j)$, $b_2(i,j)$, $b_3(i,j)$ was varied for every cycle Ta. Namely, when P(i,j) was (01), values in a set of ($b_1(i,j)$, $b_2(i,j)$, $b_3(i,j)$) were changed for every cycle Ta according to three different combinations such as ($a_1(i)$, $a_2(i)$, $-a_3(i)$), ($a_1(i)$, $-a_2(i)$, $a_3(i)$), and ($-a_1(i)$, $a_2(i)$, $a_3(i)$) as shown in Table 4. When P(i,j) was (10), it was changed for every cycle Ta likewise according to three different combinations as shown in Table 4.

TABLE 4

| Gradation Level | P(i,j) | $b_1(i,j)$ | $b_2(i,j)$ | $b_3(i,j)$ |
|---|---|---|---|---|
| 4 | 11 | $-a_1(i)$ | $-a_2(i)$ | $-a_3(i)$ |
| 3 | 10 | $a_1(i)$ | $-a_2(i)$ | $-a_3(i)$ |
| | | $-a_1(i)$ | $a_2(i)$ | $-a_3(i)$ |
| | | $-a_1(i)$ | $-a_2(i)$ | $a_3(i)$ |
| 2 | 01 | $a_1(i)$ | $a_2(i)$ | $-a_3(i)$ |
| | | $a_1(i)$ | $-a_2(i)$ | $a_3(i)$ |
| | | $-a_1(i)$ | $a_2(i)$ | $a_3(i)$ |
| 1 | 00 | $a_1(i)$ | $a_2(i)$ | $a_3(i)$ |

Also with respect to the example 4, a relationship between rms values of applied voltages and resultant contrasts has been measured using an 8 row×8 column matrix liquid crystal panel similar to that used in the example 1. The result of such measurements is shown in FIG. 16. When all P(i,j) of the 8 elements of display vectors on column j are either (11) or (00), the same effects as in the example 1 were obtained as plotted by curves 54 and 55. Then, in such a case where P(i,j) being either (01) or (10) are included in the 8 elements of display vectors, contrasts for P(i,j) of display elements to be defined between (11) and (00) are represented by a curve 56, the maximum contrast of which retained 15 in contrast to the example 3 where its maximum contrast dropped to 12. This is interpreted such that since values of $b_1(i,j)$, $b_2(i,j)$ and $b_3(i,j)$ were changed for every cycle Ta, the correlation between the display vectors and the scanning vectors was caused to change per cycle Ta, thereby the bias in the waveform of $g(j,t_1)$ which occurred in the example 2 was time-averaged to become smaller. When we applied display vectors [(11), (00), (10), (01), (00), (10), (01), (00)] to the first column, and [(11), (00), (11), (01), (00), (11), (01), (10)] to the third column to display the pattern thereof, a ratio of brightness Br(1,2)/Br(3,2) between the display elements on the first row by second column and the third row by second column became 0.75 in the example 4 of the invention as against 0.6 which was obtained when the values of $b_1(i,j)$, $b_2(i,j)$ and $b_3(i,j)$ were not changed for every cycle Ta, thus, exhibiting a greatly increased suppression effect on cross talk.

[Example 5]

Figure 17:
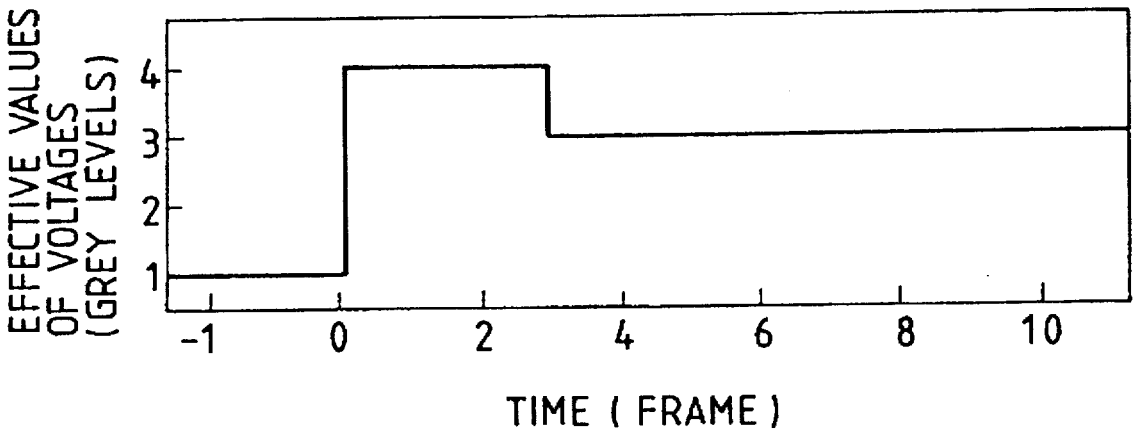
FIG. 17 is a block diagram illustrating how an rms value of voltage is applied when switching from a low voltage level to a high voltage level.

An example 5 of still another preferred embodiment of the invention will be described in the following. Using the same drive method as in the example 3, when P(i,j) was switched such as 00→01, 00→10, or 01→10, namely when an rms value of an applied voltage was switched from a low voltage to a high voltage and in particular when it was switched to an applied high voltage which was smaller than a maximum allowable high voltage, it was arranged such that the maximum allowable high voltage was applied only for initial three cycles of period upon the occurrence of switching. For example, when it was switched 00→10, the rms value of the applied voltage became as shown in FIG. 17.

A preferred drive circuit which can realize the above operation can be implemented by incorporating a comparator circuit and a signal generator circuit capable of accepting interrupts into an arithmetic circuit which calculates a voltage function to apply to a column electrode. The incorporated comparator circuit compares two display information of the two line memories, and when there exist such relationships as 00→01, 00→10 or 01→10 between particular display information in advance by one cycle of frame and the subsequent display information caused the signal generator circuit to generate a pulse which would render the display information to become (11) during the subsequent 3 frames of cycles, i.e., for 45 ms. For example, when the display information was (10), a pulse waveform of (01) was generated to be added thereto so as to result in (11), which was then added to a computing circuit for executing an exclusive-or operation. During the other periods other than the above-mentioned 3 frames of cycle, the signal generator circuit was adapted to generate (00).

Figure 18:
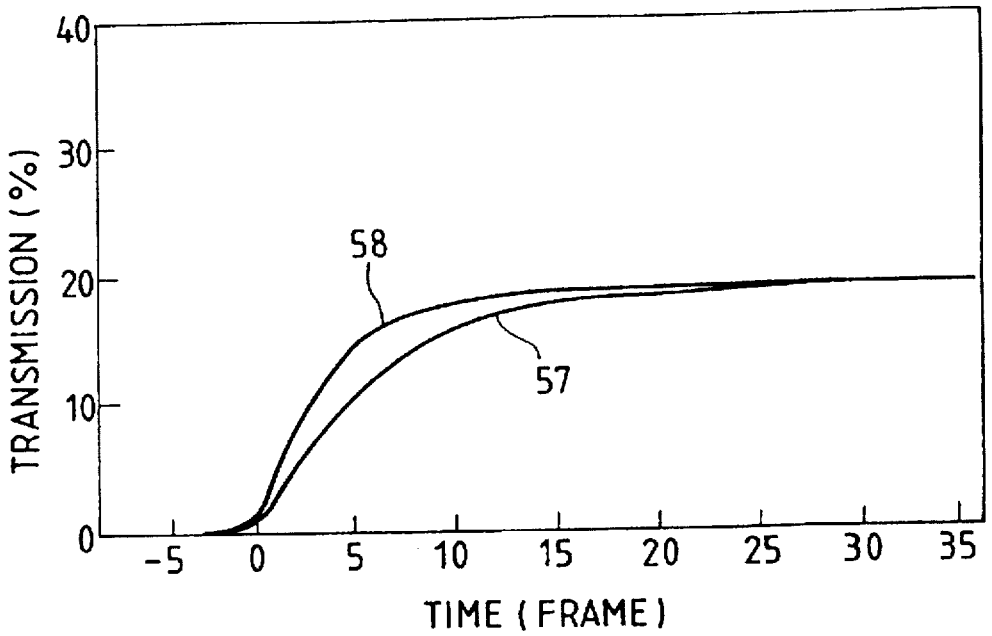
FIG. 18 shows an example of time response characteristics of the liquid crystal cell when it was driven by the rms voltage value drive method of FIG. 17.

By switching the display information 00→01 on the same liquid crystal panel as that of the example 1, a relationship of time vs. transmission was measured, the result of which is shown in FIG. 18. A curve 57 represents the case where the drive method of the example 3 was utilized to drive the LCD panel, where its transmission rose to 90% at 180 ms. A curve 58 represents the case where the drive method of the example 5 was utilized to drive the LCD panel where its transmission rose to 90% at 110 ms. As is clearly understood from the foregoing, application of the maximum allowable voltage only for the first two cycles of period, can substantially improve the response characteristics at the rise time when displaying grey levels or half tones.

[Example 6]

An example 6 of still further embodiment of the invention will be described in the following. With regard to a voltage waveform to be applied to the LCD, 32 small intervals $t_l$(l=1, 2, . . . , 32) constitute one frame cycle T, and a voltage function to be applied to each of the 8 row electrodes was set to be the same as in the example 2. Further, a display unit was also the same as in the example 2.

According to the example 6 of the invention, display information P(i,j) is composed of 3 bits, which depending on a particular gradation that a dot at a cross point of row i and column j is to display assumes either one of 8 values such as (000) for a first level gradation display, (001) for a second level gradation display, (010) for a third gradation display, (011) for a fourth level gradation display, (100) for a fifth level gradation, (110) for a seventh level gradation display, and (111) for an eighth level gradation display. Table 5 shows relationships of functions constituting P(i,j) and $g(j,t_1)$, in particular, of coefficients $b_1(i,j)$, $b_2(i,j)$, $b_3(i,j)$ and $b_4(i,j)$ associated with four functions $B_1(i,t_1)$, $B_2(i,t_1)$, $B_3(i,t_1)$ and $B_4(i,t_1)$ which pertain to P(i,j).

TABLE 5

| Gradation Levels | P(i,j) | $b_1(i,j)$ | $b_2(i,j)$ | $b_3(i,j)$ | $b_4(i,j)$ |
|---|---|---|---|---|---|
| 8 | 111 | $-1.0000a_1(i)$ | $-1.0000a_2(i)$ | $-1.0000a_3(i)$ | $-1.0000a_4(i)$ |
| 7 | 110 | $-0.3104a_1(i)$ | $-0.3104a_2(i)$ | $-0.3104a_3(i)$ | $-1.9264a_4(i)$ |
| 6 | 101 | $0.0930a_1(i)$ | $0.0930a_2(i)$ | $0.0930a_3(i)$ | $-1.9935a_4(i)$ |
| 5 | 100 | $0.4286a_1(i)$ | $0.4286a_2(i)$ | $0.4286a_3(i)$ | $-1.8571a_4(i)$ |
| 4 | 011 | $0.7144a_1(i)$ | $0.7144a_2(i)$ | $0.7144a_3(i)$ | $-1.5713a_4(i)$ |
| 3 | 010 | $0.9502a_1(i)$ | $0.9502a_2(i)$ | $0.9502a_3(i)$ | $-1.1364a_4(i)$ |
| 2 | 001 | $1.1182a_1(i)$ | $1.1182a_2(i)$ | $1.1182a_3(i)$ | $-0.4989a_4(i)$ |
| 1 | 000 | $1.0000a_1(i)$ | $1.0000a_2(i)$ | $1.0000a_3(i)$ | $1.0000a_4(i)$ |

Using equations 14 through 16, an effective voltage value Urms(i,j) applied according to U(i,j) to a pixel on a cross point of row i and column j was calculated likewise the example 3, which is expressed by the following equation (25).

$$Urms^2(i,j) = \frac{1}{2\sqrt{2}-1} \quad \text{eq. (25)}$$

-continued $$\left[2\sqrt{2}-\frac{1}{4}\,(a_1(i)b_1(i,j)+a_2(i)b_2(i,j)+a_3(i)b_3(i,j)+a_4(i)b_4(i,j)\right]$$

By allowing a set of $b_1(i,j)$, $b_2(i,j)$, $b_3(i,j)$ and $b_4(i,j)$ to take respective combinations of values as shown in Table 5, Urms(i,j) has been confirmed to assume 8 different steps of values as expressed by the following equations (26) through (33) so as to be able to display 8 different levels of gradation displays.

(1) when $b_k(i,j)=-1$ (where k=1~4), $$U_{rms8}(i,j)=\frac{1}{2\sqrt{2}-1}\,[2\sqrt{2}+1]=\frac{2\sqrt{2}+1}{2\sqrt{2}-1} \quad \text{eq. (26)}$$

(2) when $b_k(i,j)=-0.3104$(k=1~3) and $b_4(i,j)=-1.9264$, $$U^2_{rms7}(i,j)=\frac{1}{2\sqrt{2}-1}\,[2\sqrt{2}+0.7144]=\frac{2\sqrt{2}+0.7144}{2\sqrt{2}-1} \quad \text{eq. (27)}$$

(3) when $b_k(i,j)=0.093$(k=1~3) and $b_4(i,j)=-1.9935$, $$U^2_{rms6}(i,j)=\frac{1}{2\sqrt{2}-1}\,[2\sqrt{2}+0.4286]=\frac{2\sqrt{2}+0.486}{2\sqrt{2}-1} \quad \text{eq. (28)}$$

(4) when $b_k(i,j)=0.4286$(k=1~3) and $b_4(i,j)=-1.8571$, (5) when $b_k(i,j)=0.7144$(k=1~3) and $b_4(i,j)=-1.5713$, (6) when $b_k(i,j)=0.9502$(k=1~3) and $b_4(i,j)=-1.1364$, $$U^2_{rms5}(i,j)=\frac{1}{2\sqrt{2}-1}\,[2\sqrt{2}+0.1428]=\frac{2\sqrt{2}+0.1428}{2\sqrt{2}-1} \quad \text{eq. (29)}$$

$$U^2_{rms4}(i,j)=\frac{1}{2\sqrt{2}-1}\,[2\sqrt{2}-0.1430]=\frac{2\sqrt{2}-0.1430}{2\sqrt{2}-1} \quad \text{eq. (30)}$$

$$U^2_{rms3}(i,j)=\frac{1}{2\sqrt{2}-1}\,[2\sqrt{2}-0.4286]=\frac{2\sqrt{2}-0.4286}{2\sqrt{2}-1} \quad \text{eq. (31)}$$

(7) when $b_k(i,j)=1.1182$(k=1~3) and $b_4(i,j)=-0.4989$, $$U^2_{rms2}(i,j)=\frac{1}{2\sqrt{2}-1}\,[2\sqrt{2}-0.7139]=\frac{2\sqrt{2}-0.7139}{2\sqrt{2}-1} \quad \text{eq. (32)}$$

(8) when $b_k(i,j)=1$(k=1~4), $$U^2_{rms1}(i,j)=\frac{1}{2\sqrt{2}-1}\,[2\sqrt{2}-1]=1 \quad \text{eq. (33)}$$

The liquid crystal drive circuit described above can be implemented using the same arrangement as that of the example 3 except for such arrangements for enabling its display information to take 3 bits and for its driver voltage for driving the row electrodes to take 5 levels of voltage values.

Figure 19:
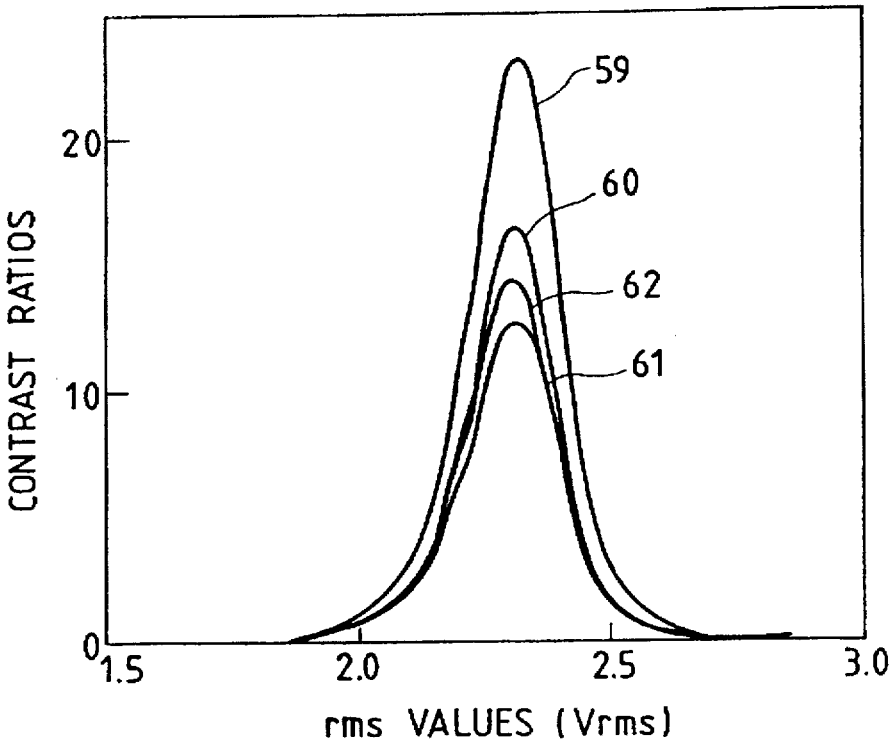
FIG. 19 shows relationships between rms values of applied voltages and resultant contrast ratios when each row was driven by a sum of four Walsh functions to display a gradation pattern.

Also with respect to the example 6 of the invention, using the same 8 rows by 8 columns matrix liquid crystal panel as that in the example 1, a relationship between rms values of voltages applied to the liquid crystal and its resultant contrasts has been measured. The results of such measurements are shown in FIG. 19. When every P(i,j) of 8 elements of display vectors on the j-th column were (111) or (000), the same effect as by the example 2 was obtained, resulting in curves 59 or 60. However, when any or a combination of (110), (101), (100), (011), (101) or (001) were included as P(i,j) in the 8 elements of the display vectors, a contrast ratio between (111) and (000) became as indicated by a curve 61 the maximum contrast of which dropped to as low as 13. This occurred due to a bias or irregular distribution occurred in the waveform of $g(j,t_1)$ since $b_1(i,j)$, $b_2(i,j)$, $b_3(i,j)$ and $b_4(i,j)$ were changed independently of one another corresponding to P(i,j). Thereby, by every frame likewise as in the example 4, a curve 62 was obtained, the maximum contrast of which improved to 15.

According to the drive method for driving the STN liquid crystal display device of the invention, since the change due to the display pattern in the waveform of the applied voltage specified by the following equation (34) and to be applied as a column signal can be reduced, the degradation of contrast and the cross talk effect due to the biased drive waveform can be suppressed substantially.

$$U(i,j)=f(i,t)-g(j,t) \quad \text{eq. (34)}$$

In the case of the example 1 using the 8 row by 8 column matrix display, the drop of contrast was advantageously reduced by 20%, and the cross talk was suppressed approximately to a half. Further, in the gradation display, computing of correction coefficients which have been necessary in the prior art orthogonal function drive methods is no more required, thereby reducing the computing load on the arithmetic circuit as well.

What is claimed is:

1. A method for driving a matrix addressing display device, the matrix addressing display device including N row electrodes (N≧2) to each of which is to be applied a row signal constituting a scanning signal, at least one column electrode to each of which is to be applied a column signal constituting a signal depending on display data, and a plurality of display picture elements coupled to said row electrodes and said at least one column electrode, the method for driving the matrix addressing display device comprising the steps of:

specifying a display period Ta composed of $m_r$ intervals $t_l$(l=1 to $m_r$) ($m_r$>N), one interval $t_1$ being a basic unit display cycle of the row signal and the column signal; and applying to an i-th row electrode of the row electrodes as the row signal a voltage waveform produced on the basis of a weighted sum of a plurality of orthogonal functions which are orthogonal to each other, the plurality of orthogonal functions each having a value of 1 or −1 during each of the intervals $t_1$.

2. A method for driving a matrix addressing display device according to claim 1, wherein the plurality of orthogonal functions are $2^n$ orthogonal functions (n=1, 2, 3, . . .).

3. A method for driving a matrix addressing display device according to claim 1, wherein the display picture elements are formed by disposing and holding a liquid crystal material in a cell between two glass substrates each having electrodes made of a metal or oxide and an oriented film disposed thereon, the electrodes disposed on the two glass substrates forming the row electrodes and the at least one column electrode, polarization plates being disposed on both sides of said cell; and wherein said liquid crystal material is a nematic liquid crystal material, and a twist angle of said liquid crystal material in said cell is in a range from 220 degrees to 270 degrees inclusive.

4. A method for driving a matrix addressing display device, the matrix addressing display device including N row electrodes ($N \geqq 2$) to each of which is to be applied a row signal constituting a scanning signal, at least one column electrode to each of which is to be applied a column signal constituting a signal depending on display data, and a plurality of display picture elements coupled to said row electrodes and said at least one column electrode, the method for driving the matrix addressing display device comprising the steps of:

specifying a display period Ta composed of $m_r$ intervals $t_1$($l$=1 to $m_r$) ($m_r$>N), one interval $t_1$ being a basic unit display cycle of the row signal and the column signal;

applying to an i-th row electrode of the row electrodes as the row signal a voltage waveform produced on the basis of a weighted sum of a plurality of orthogonal functions which are orthogonal to each other, the plurality of orthogonal functions each having a value of 1 or −1 during each of the intervals $t_1$; and applying to remaining ones of the row electrodes a voltage waveform produced on the basis of at least one function which is orthogonal to the plurality of orthogonal functions;

wherein the voltage waveform applied to the i-th row electrode is specified by a function $f(i,t_1)$ expressed by the following equation:

$$f(i,t_l) = C_P \sum_{k=1}^{K} a_k(i) B_k(i,t_l)$$

$$C_P = \sqrt{\frac{\sqrt{N}}{2K(\sqrt{N}-1)}}$$

whereby $f(i,t_1)$ is represented by a sum of K orthogonal functions $B_k(i,t_1)$ (k=1, 2, . . . K, where K is a constant which is equal to or greater than 2) which are orthogonal to each other for different k and i; and wherein a voltage waveform to be applied to a j-th column electrode of the at least one column electrode is specified by a function $g(j,t_1)$ expressed by the following equation:

$$g(j,t_l) = \frac{C_P}{\sqrt{N}} \sum_{i=1}^{N} \sum_{k=1}^{K} b_k(i,j) B_k(i,t_l)$$

where $b_k(i,j)$ is a constant depending on $a_k(i)$ and P(i,j), where P(i,j)=+1 when a display picture element coupled to the i-th row electrode and the j-th column electrode is in an on-state, and P(i,j)=−1 when the display picture element coupled to the i-th row electrode and the j-th column electrode is in an off-state, and where $a_k(i)$ is a constant which designates a weight of a k-th function $B_k(i,t_1)$ of the K orthogonal functions.

5. A method for driving a matrix addressing display device, the matrix addressing display device including N row electrodes ($N \geqq 2$) to each of which is to be applied a row signal constituting a scanning signal, at least one column electrode to each of which is to be applied a column signal constituting a signal depending on display data, and a plurality of display picture elements coupled to said row electrodes and said at least one column electrode, the method for driving the matrix addressing display device comprising the steps of:

specifying a display period Ta composed of $m_r$ intervals $t_1$ ($l$=1 to $m_r$), ($m_r$>N), one interval $t_1$ being a basic unit display cycle of the row signal and the column signal;

applying to an i-th row electrode of the row electrodes as the row signal a voltage waveform produced on the basis of a weighted sum of a plurality of orthogonal functions which are orthogonal to each other, the plurality of orthogonal functions each having a value of 1 or −1 during each of the intervals $t_1$; and applying to remaining ones of the row electrodes a voltage waveform produced on the basis of at least one function which is orthogonal to the plurality of orthogonal functions;

wherein $B_k(i,t_1)$ (k=1, 2, . . . K, where $K \geqq 2$, and i=1,2, . . . N) represent K orthogonal functions which are orthogonal to each other and which constitute the plurality of orthogonal functions used in producing the row signal applied to the i-th row electrode, $a_k(i)$ (k=1, 2, . . . K, where $K \geqq 2$, and i=1, 2, . . . N) represents K constants for weighting respective ones of the K orthogonal functions $B_k(i,t_1)$, $B_k(i',t_1)$ (k=1, 2, . . . K, where $K \geqq 2$, and i'=1, 2, . . . N) represents K×N functions to be used to produce a column signal to be applied to a j-th column electrode of the at least one column electrode, and $b_k(i,j)$ (k=1, 2, . . . K , where $K \geqq 2$, and i=1, 2, . . . N) represents K constants for weighting respective ones of the K orthogonal functions $B_k(i,t_1)$, $b_k(i,j)$ depending on display data for a display picture element coupled to the i-th row and the j-th column;

wherein the K constants $a_i(k)$ and the K constants $b_k(i,j)$ are different for each of a plurality of gradation display levels; and wherein a sum of squares $a_1^2(i)+a_2^2(i)+\ldots a_k^2(i)$ and a sum of squares $b_1^2(i,j)+b_2^2(i,j)+\ldots b_k^2(i,j)$ each have a constant value independent of i and gradation display level.

6. A method for driving a matrix addressing display device according to claim 5, wherein an absolute value of each of the K constants $a_k(i)$ is a same value ac independent of i and gradation display level, and the sum of squares $b_1^2(i,j)+b_2^2(i,j)+\ldots b_k^2(i,j)$ has a constant value of Kxac independent of i and gradation display level.

7. A method for driving a matrix addressing display device according to claim 5, further comprising the step of periodically changing the K constants $a_k(i)$ and the K constants $b_k(i,j)$ for at least one of the gradation display levels.

8. A method for driving a matrix addressing display device according to claim 5, wherein a difference between the row signal for the i-th row electrode and the column signal for the j-th column electrode is an rms voltage applied to a display picture element coupled to the i-th row electrode and the j-th column electrode; and wherein the method for driving a matrix addressing display device further comprises the step of:

applying a maximum allowable voltage to the display picture element coupled to the i-th row electrode and the j-th column electrode during a preset period of time within 100 ms from a time when the rms voltage applied to the display picture element coupled to the i-th row electrode and the j-th column electrode changes from a low voltage to a high voltage.

9. A matrix addressing display device comprising:

N row electrodes ($N \geqq 2$) to each of which is to be applied a row signal constituting a scanning signal;

M column electrodes ($M \geqq 1$) to each of which is to be applied a column signal constituting a signal depending on display data;

a plurality of display picture elements coupled to said row electrodes and said column electrodes;

row electrode drive means for generating the row signal; and column electrode drive means for generating the column signal;

wherein a difference between the row signal for an i-th row electrode of the row electrodes and the column signal for a j-th column electrode of the column electrodes is an rms voltage applied to a display picture element coupled to the i-th row electrode and the j-th column electrode;

wherein the display picture element coupled to the i-th row electrode and the j-th column electrode turns on or off in accordance with the rms voltage;

wherein the row electrode drive means generates as the row signal a voltage waveform produced on the basis of a weighted sum of K orthogonal functions $B_k(i,t_1)$ ($k=1, 2, \ldots K$, where $K \geqq 2$, and $i=1, 2, \ldots N$) which are orthogonal to each other, the K orthogonal functions $B_k(i,t_1)$ each having a value of 1 or −1 during each of $m_t$ intervals $t_1$ ($l=1$ to $m_1$), one interval $t_1$ being a basic unit display cycle of the row signal and the column signal, the mt intervals composing a display period Ta; and wherein the column electrode drive means generates as the column signal a voltage waveform specified by a function $g(j,t_1)$ expressed by the following equation:

$$g(j,t_l) = \frac{C_P'}{\sqrt{N}} \sum_{i=1}^{N} \sum_{k=1}^{K} b_k(i,j) B_k(i,t_l)$$

$$C_P' = \sqrt{\frac{\sqrt{N}}{2K(\sqrt{N}-1)}} \times V_{NS}$$

where $b_k(i,j)$ is a constant depending on P(i,j) and the row signal for the i-th row, where P(i,j)=+1 when the display picture element coupled to the i-th row electrode and the j-th column electrode is in an on-state, and P(i,j)=−1 when the display picture element coupled to the i-th row electrode and the j-th column electrode is in an off-state, and where $V_{NS}$ is an rms voltage applied to any display picture element when it is in the off-state.

10. A matrix addressing display device according to claim 9, wherein said plurality of display picture elements are formed by a liquid crystal disposed and held in a cell between two glass substrates each having electrodes made of a metal or oxide and an oriented film disposed thereon, the electrodes disposed on the two glass substrates forming the row electrodes and the column electrodes, polarization plates being disposed on both sides of the cell; and wherein said liquid crystal material is a nematic liquid crystal material, and a twist angle of said liquid crystal material in said cell is in a range from 220 degrees to 270 degrees inclusive.

* * * * *